US010700450B2

(12) United States Patent
Benham

(10) Patent No.: US 10,700,450 B2
(45) Date of Patent: Jun. 30, 2020

(54) RF CONNECTOR

(71) Applicant: Winchester Interconnect Corporation, Norwalk, CT (US)

(72) Inventor: John E. Benham, Torrington, CT (US)

(73) Assignee: WINCHESTER INTERCONNECT CORPORATION, Norwalk, CT (US)

( * ) Notice: Subject to any disclaimer, the term of this patent is extended or adjusted under 35 U.S.C. 154(b) by 0 days.

(21) Appl. No.: 16/138,231

(22) Filed: Sep. 21, 2018

(65) Prior Publication Data

US 2020/0099145 A1 Mar. 26, 2020

(51) Int. Cl.
*H01R 9/05* (2006.01)
*H01B 11/18* (2006.01)

(52) U.S. Cl.
CPC ..... *H01R 9/0518* (2013.01); *H01B 11/1808* (2013.01); *H01B 11/1834* (2013.01)

(58) Field of Classification Search
CPC ..... H01R 9/05; H01R 24/545
USPC ..... 174/75 C; 439/582
See application file for complete search history.

(56) References Cited

U.S. PATENT DOCUMENTS 2,335,041 A * 11/1943 Bruno ..... H01R 24/545 174/87
4,556,265 A 12/1985 Cunningham
5,061,206 A * 10/1991 Kawanami ..... H01R 9/0518 439/582
5,322,453 A 6/1994 Resnick et al.
5,607,325 A 3/1997 Toma
6,075,488 A 6/2000 Hope
6,126,482 A * 10/2000 Stabile ..... H01R 24/545 439/578
6,166,615 A 12/2000 Winslow et al.
6,264,475 B1 7/2001 Machado
6,299,491 B1 10/2001 Bruce
6,602,093 B1 8/2003 Cannon
6,609,925 B1 8/2003 Cannon
6,786,767 B1 9/2004 Fuks et al.
6,817,899 B1 11/2004 Zerebilov
6,933,713 B2 8/2005 Cannon
7,104,826 B2 9/2006 Zahlit et al.
7,244,146 B2 7/2007 Gherardini
7,384,306 B2 6/2008 Malstrom et al.
7,455,542 B2 11/2008 Norwood et al.
7,878,860 B1 2/2011 Ouellette et al.
RE42,926 E 11/2011 Norwood et al.
8,206,179 B2 6/2012 Ouellette et al.
(Continued)

*Primary Examiner* — Chau N Nguyen
(74) *Attorney, Agent, or Firm* — Rothwell, Figg, Ernst & Manbeck, P.C.

(57) ABSTRACT

A connector secured to a coaxial cable having a conducting core. The connector includes a housing having a body having a central vertical axis and defining a chamber extending along the central vertical axis, a dielectric disposed in the chamber of the housing; and a signal contact disposed in the chamber of the housing and held by the dielectric. The signal contact includes a head having a top face and an opposite bottom face, a ferrule member projecting away from the top face of the head, and a pin projecting away from the bottom face of the head. The ferrule member includes a passage extending in a direction transverse to the central vertical axis, and the passage receives a terminating portion of the conducting core. The ferrule member is crimped to the terminating portion of the conducting core.

20 Claims, 22 Drawing Sheets

(56) References Cited

U.S. PATENT DOCUMENTS

| | | | | |
|---|---|---|---|---|
| 8,262,408 | B1 | 9/2012 | Kelly | |
| 8,366,483 | B2 | 2/2013 | Hardy et al. | |
| 8,491,328 | B2 | 7/2013 | Mulfinger et al. | |
| 8,618,990 | B2 | 12/2013 | Somero | |
| 8,866,689 | B2 | 10/2014 | Islam | |
| 9,136,654 | B2 | 9/2015 | Matzen | |
| 9,172,154 | B2 | 10/2015 | Burris | |
| 9,214,743 | B2 | 12/2015 | Duesterhoeft et al. | |
| 9,277,204 | B2 | 3/2016 | Gilliland et al. | |
| 9,287,659 | B2 | 3/2016 | Burris et al. | |
| 9,407,016 | B2 | 8/2016 | Burris | |
| 9,420,264 | B2 | 8/2016 | Gilliland et al. | |
| 9,484,645 | B2 | 11/2016 | Matzen | |
| 9,537,231 | B2 | 1/2017 | Hall et al. | |
| 9,548,572 | B2 | 1/2017 | Burris et al. | |
| 9,673,587 | B2 | 6/2017 | Pechter et al. | |
| 9,722,363 | B2 | 8/2017 | Burris et al. | |
| 9,762,008 | B2 | 9/2017 | Burris et al. | |
| 9,797,995 | B2 | 10/2017 | Gilliland et al. | |
| 9,799,983 | B2 | 10/2017 | Lane et al. | |
| 9,837,778 | B2 | 12/2017 | Pechter et al. | |
| 9,875,845 | B2 | 1/2018 | Poehmerer | |
| 9,912,105 | B2 | 3/2018 | Burris et al. | |
| 9,991,650 | B2 | 6/2018 | Lane | |
| 9,991,651 | B2 | 6/2018 | Burris et al. | |
| 2016/0226202 | A1* | 8/2016 | Paynter | H01R 9/05 |

* cited by examiner

RF CONNECTOR

FIELD OF THE DISCLOSURE

This disclosure relates to electrical connectors for coaxial cables.

BACKGROUND

Radio frequency (RF) connector assemblies are implemented in numerous technologies, including medical equipment. For example, Magnetic Resonance Imaging (MRI) scanners typically use a volume coil to receive electromagnetic radiation produced by the nuclear relaxation inside the patient by securing the volume coil to a cage of the scanner and routing coaxial cables to a receiver for signal processing. In conventional MRI scanners, the coaxial cable terminates at a RF connector, which is linked to the receiver. At the termination, a center conductor of the coaxial cable is typically soldered to the contact in the RF connector.

SUMMARY

Because each cage of the conventional MRI scanner is designed for a specific body part, the cage is usually switched out many times per day to address multiple patients. Each exchange of the cage exerts force on the cable, thereby placing stress on the soldered joint between the center conductor and the contact in the RF connector. Ultimately, over time, the applied stress compromises the integrity of the soldered joint, interrupting the signal processing by the receiver. Moreover, the size of a conventional RF connector for a MRI scanner is small, making the soldering process difficult.

Accordingly, there is a need for a connector assembly that can ensure a secure and reliable connection at the terminating end of a center conductor of a coaxial cable. Furthermore, it is desirable to secure the terminating end of the center conductor to the contact in the RF connector using a simpler process.

The present disclosure includes various examples of a connector for coupling to a coaxial cable. In accordance with one embodiment, the connector may comprise a housing comprising a body having a central vertical axis and defining a chamber extending along the central vertical axis of the body, a dielectric disposed in the chamber of the housing, and a signal contact disposed in the chamber of the housing and held by the dielectric. In some embodiments, the signal contact comprises a head having a top face and an opposite bottom face, a ferrule member projecting away from the top face of the head, and a pin projecting away from the bottom face of the head. In some embodiments, the ferrule member may comprise a passage extending in a direction transverse to the central vertical axis, and the passage is configured to receive a terminating portion of the conducting core of the coaxial cable. In some embodiments, the head may comprise a transverse dimension and the ferrule member comprises a lateral transverse dimension, and the lateral transverse dimension of the ferrule member is less than the transverse dimension of the head.

In some embodiments, the ferrule member is configured to be crimped to the terminating portion of the conducting core of the coaxial cable. In some embodiments, the housing may further comprise arm projecting from a front wall of the body, and a leg projecting from a bottom end of the body. In some embodiments, the arm may comprise a passage extending opening into the chamber. In some embodiments, the passage of the arm is aligned with the passage of the ferrule member and configured to receive the terminating portion of the conducting core of the coaxial cable. In some embodiments, the leg may comprise a passage opening into the chamber; and the pin is received in the passage of the leg.

In some embodiments, the pin extends through a passage in the dielectric. In some, embodiments, the dielectric comprises a plug having a top face, a bottom face, and a sidewall, and a bottom face of the head abuts against the top face of the plug. In some embodiments, the sidewall of the plug engages the interior surface of the housing, and the head and the ferrule member are spatially separated from the interior surface of the housing.

The present disclosure includes various examples of a connector assembly. In accordance with one embodiment, the connector assembly comprises a coaxial cable and a connector. In some embodiments, the coaxial cable may comprise a conducting core extending along a longitudinal axis of the cable, an insulating sleeve received around the conducting core, and a cable shield having a first segment received around the insulating sleeve and a second segment spatially separated from the insulating sleeve proximate to a terminating end of the conducting core. In some embodiments, the connector may comprise a housing comprising a body having a central vertical axis and defining a chamber extending along the central vertical axis, a dielectric disposed in the chamber of the housing, and a signal contact disposed in the chamber of the housing and held by the dielectric. In some embodiments, the signal contact may comprise a head having a top face and an opposite bottom face, a ferrule member projecting away from the top face of the head, and a pin projecting away from the bottom face of the head. In some embodiments, the ferrule member comprises a passage extending in a direction transverse to the central vertical axis. In some embodiments, the terminating portion of the conducting core is received in the passage of the ferrule member, and the ferrule member is crimped to the terminating portion of the conducting core.

In some embodiments, the arm may comprise a passage extending transverse to the central vertical axis and opening into the chamber. In some embodiments, the passage of the arm is aligned with the passage of the ferrule member. In some embodiments, the conducting core and the insulating sleeve of the coaxial cable are received in the passage of the arm.

In some embodiments, the second segment of the cable shield is received around the arm, and the connector may comprise a ferrule tube received around the second segment of the cable shield and the arm of the housing. In some embodiments, the ferrule tube is crimped to the cable shield and the arm of the housing. In some embodiments, the leg comprises a passage extending in the axial direction and opening into the chamber. In some embodiments, the pin is received in the passage of the leg. In some embodiments, the head may comprise a transverse dimension and the ferrule member may comprise a lateral transverse dimension, and the lateral transverse dimension of the ferrule member is less than the transverse dimension of the head.

The present disclosure includes various examples of a method of crimping a coaxial cable having a conducting core to a connector having a housing having a body having a central vertical axis and defining a chamber extending along the central vertical axis, a signal contact, and a dielectric. In accordance with one embodiment, the method may comprise a step of inserting a terminating portion of the conducting core into a passage of a ferrule member of the signal contact, a step of placing a cable shield of the coaxial cable around a portion of an arm of the housing, a step of placing a ferrule tube around a portion of the cable shield, a step of applying, by a punch, a force against the ferrule member of the signal contact in a direction parallel to the central vertical axis to form a crimp connection between the ferrule member and terminating portion of the conducting core, and a step of compressing, by an upper die member and a lower die member, the ferrule tube to form a crimp connection between the ferrule tube, the cable shield, and the arm of the housing.

In some embodiments, the steps of applying and compressing are performed simultaneously. In some embodiments, the crimp connection between the ferrule member and the terminating portion of the conducting core is a B-crimp. In some embodiments, the crimp connection between the ferrule tube, the cable shield, and the arm of the housing is a hexagonal crimp. In some embodiments, the punch is disposed in the upper die member.

In some embodiments, the method may further comprise, after the steps of inserting and placing and before the steps of applying and compressing, placing a leg of the housing into a nest disposed in the lower die member, and placing the ferrule tube received around the cable shield and the arm of the housing between a first recess disposed along an engagement surface of the lower die member and a second recess disposed along an engagement surface of the upper die member.

The present disclosure includes various examples of a method of crimping a coaxial cable having a conducting core to a connector. The method may comprise a step of obtaining the connector, in which the connector comprises a housing having a body having a central vertical axis and defining a chamber extending along the central vertical axis, a dielectric disposed in a chamber of the housing, and a signal contact disposed in the chamber of the housing. In some embodiments, the signal contact may comprise a head having a top face and an opposite bottom face, a ferrule member projecting away from the top face of the head, and a pin projecting away from the bottom face of the head. The method may comprise a step of inserting a terminating portion of the conducting core into a passage of a ferrule member of the signal contact. The method may comprise a step of applying, by a punch, a force against the ferrule member of the signal contact in a direction parallel to the central vertical axis to form a crimp connection between the ferrule member and the terminating portion of the conducting core.

In some embodiments, the step of applying may comprise inserting the punch through an opening disposed at a top end wall of the housing and into the chamber of the housing. In some embodiments, the crimp connection between the ferrule member and the conducting core is a B-crimp. In some embodiments, the step of applying may comprise pressing, by the punch, a first portion of a top end wall of the ferrule member such that the first portion of the top end wall protrudes into the passage of the ferrule member to form the crimp connection between the ferrule member and the conducting core. In some embodiments, after the step of applying, a second portion of the top end wall of the ferrule member remains substantially intact such that the first portion of the top end wall is oriented at an angle with respect to the second portion of the top end wall. In some embodiments, the second portion of the top end wall is disposed proximate to a front end wall or a back end wall of the ferrule member.

Other features and characteristics of the subject matter of this disclosure, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various embodiments of the subject matter of this disclosure. In the drawings, like reference numbers indicate identical or functionally similar elements.

DETAILED DESCRIPTION

Figure 1:
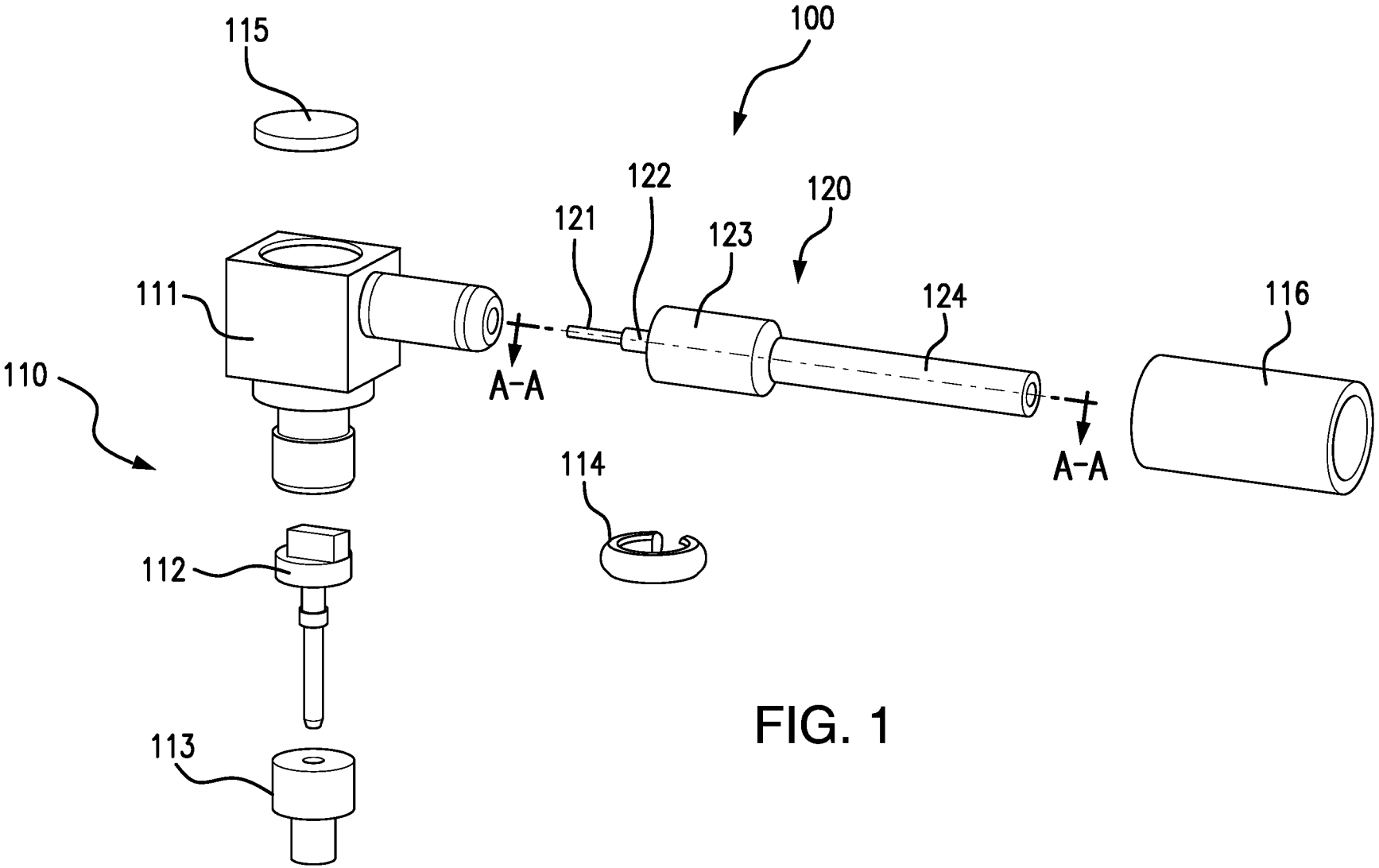
FIG. 1 is an exploded view of a connector assembly according to one example.

While aspects of the subject matter of the present disclosure may be embodied in a variety of forms, the following description and accompanying drawings are merely intended to disclose some of these forms as specific examples of the subject matter. Accordingly, the subject matter of this disclosure is not intended to be limited to the forms or embodiments so described and illustrated.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, radial, axial, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of a device embodying aspects of the disclosure and are not intended to be limiting.

The use of the term "about" applies to all numeric values specified herein, whether or not explicitly indicated. This term generally refers to a range of numbers that one of ordinary skill in the art would consider as a reasonable amount of deviation to the recited numeric values (i.e., having the equivalent function or result) in the context of the present disclosure. For example, and not intended to be limiting, this term can be construed as including a deviation of ±10 percent of the given numeric value provided such a deviation does not alter the end function or result of the value. Therefore, under some circumstances as would be appreciated by one of ordinary skill in the art a value of about 1% can be construed to be a range from 0.9% to 1.1%.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "substantially" and "substantial" refer to a considerable degree or extent. When used in conjunction with, for example, an event, circumstance, characteristic, or property, the terms can refer to instances in which the event, circumstance, characteristic, or property occurs precisely as well as instances in which the event, circumstance, characteristic, or property occurs to a close approximation, such as accounting for typical tolerance levels or variability of the embodiments described herein.

FIG. 1 shows an exploded view of a connector assembly 100 according to an embodiment. The connector assembly 100 comprises a connector 110 and a coaxial cable 120. As shown in FIG. 1, the connector 110 comprises a housing 111, a signal contact 112, a dielectric 113, a retainer 114, a cap 115, and a ferrule tube 116. The connector 110 is configured to be coupled to an end of the coaxial cable 120 such that a terminating portion 121 of a conducting core of the coaxial cable 10 is received in the housing 111 and directly coupled to the signal contact 112. When the coaxial cable 120 is coupled to the connector 110, an electrical link is established between the terminating portion 121 of the conducting core and the signal contact 112 such that the connector assembly 100 provides an electrical signal path from the conducting core to the signal contact 112, which in this embodiment, the electrical signal path is oriented at an angle of about 90°.

Figure 2:
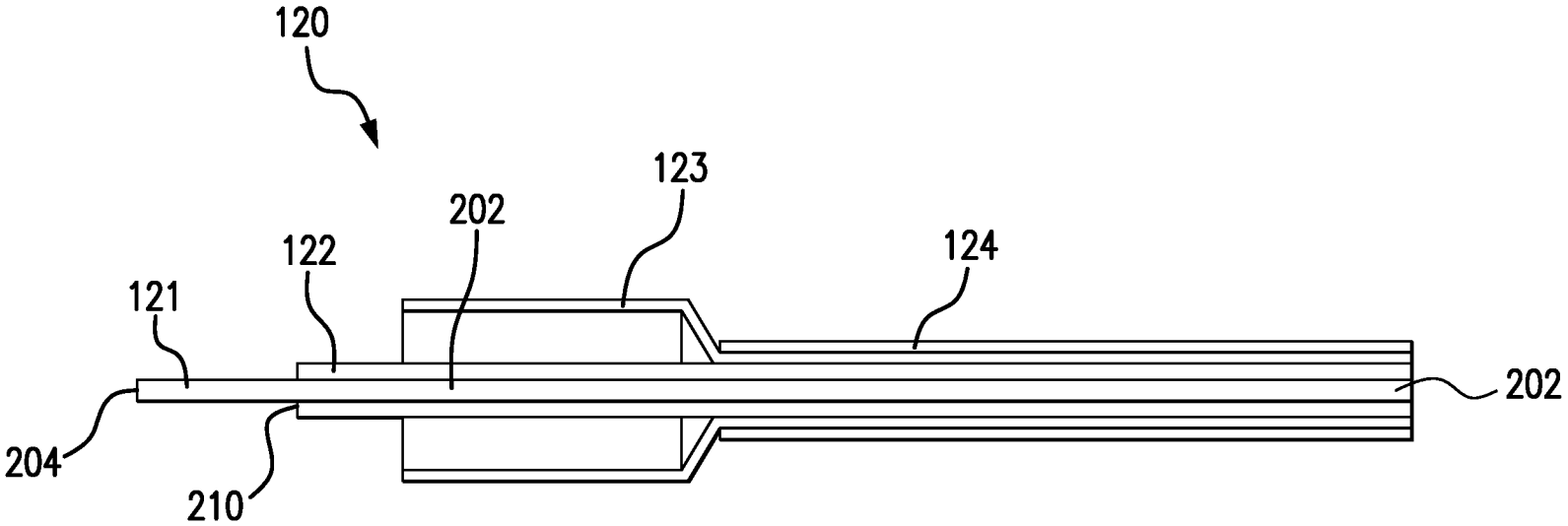
FIG. 2 is a side cross-sectional view of a coaxial cable taken along line A-A in FIG. 1 according to one example.

As shown in FIG. 2, the coaxial cable 120 comprises a conducting core 202 extending along a longitudinal axis of the cable 120 and an insulating sleeve 122 wrapped around the conducting core 202. The terminating portion 121 of the conducting core 202 projects beyond an end 210 of the insulating sleeve 122 terminates at a distal end 204 of the conducting core 202. The coaxial cable 120 further comprises a cable shield 123 that includes a first segment extending along the cable 120 and wrapped around the insulating sleeve 122 and a second segment spatially separated from the insulating sleeve 122 and terminating before reaching the end 210 of the insulating sleeve 122. The coaxial cable 120 further comprises a cable jacket 124 wrapped around the first segment of the cable shield 123 and terminating at the second segment of the cable shield 123 proximate to the end of the cable 120.

Figure 3:
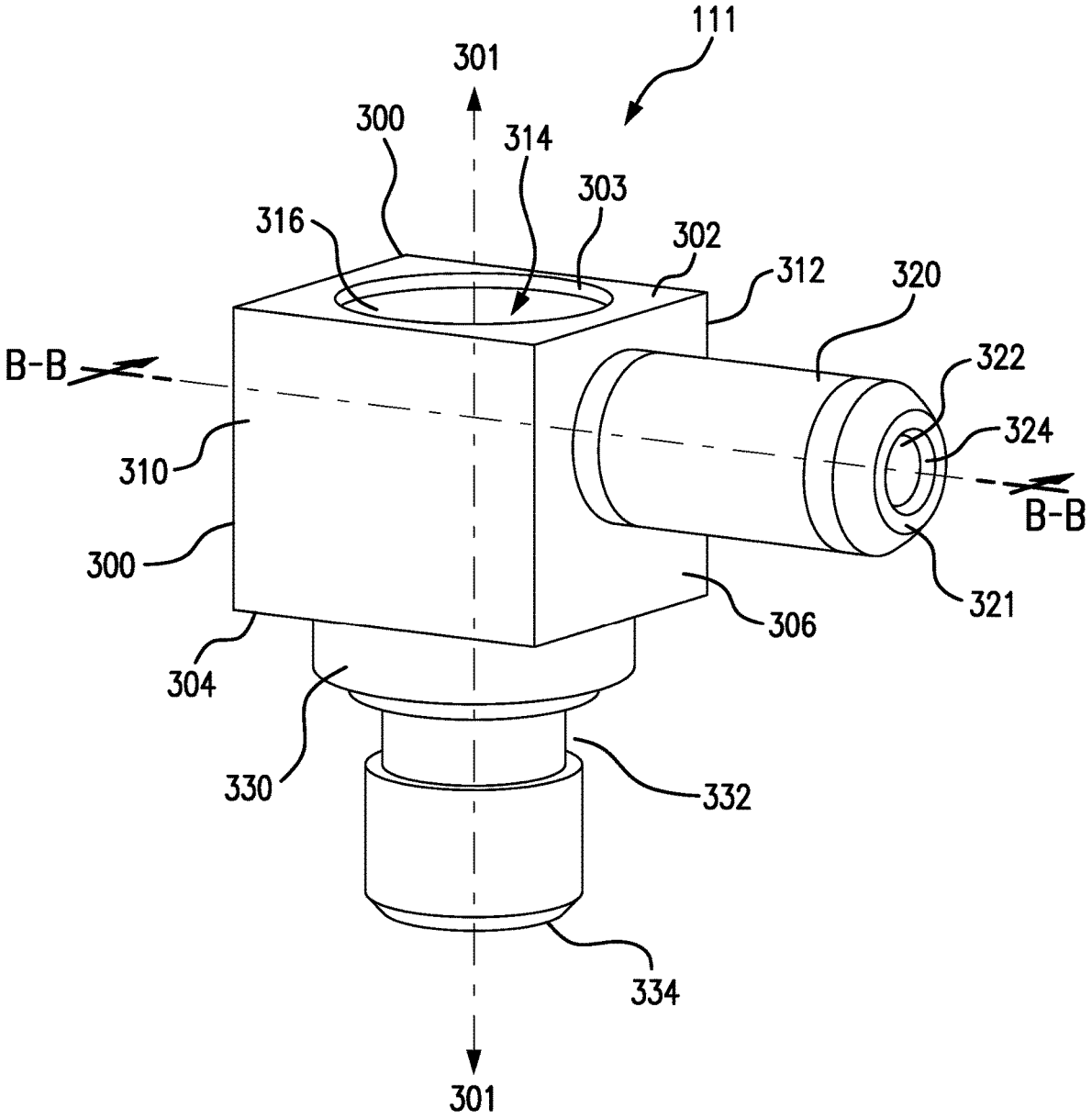
FIG. 3 is a perspective view of a connector housing according to one example.
Figure 4:
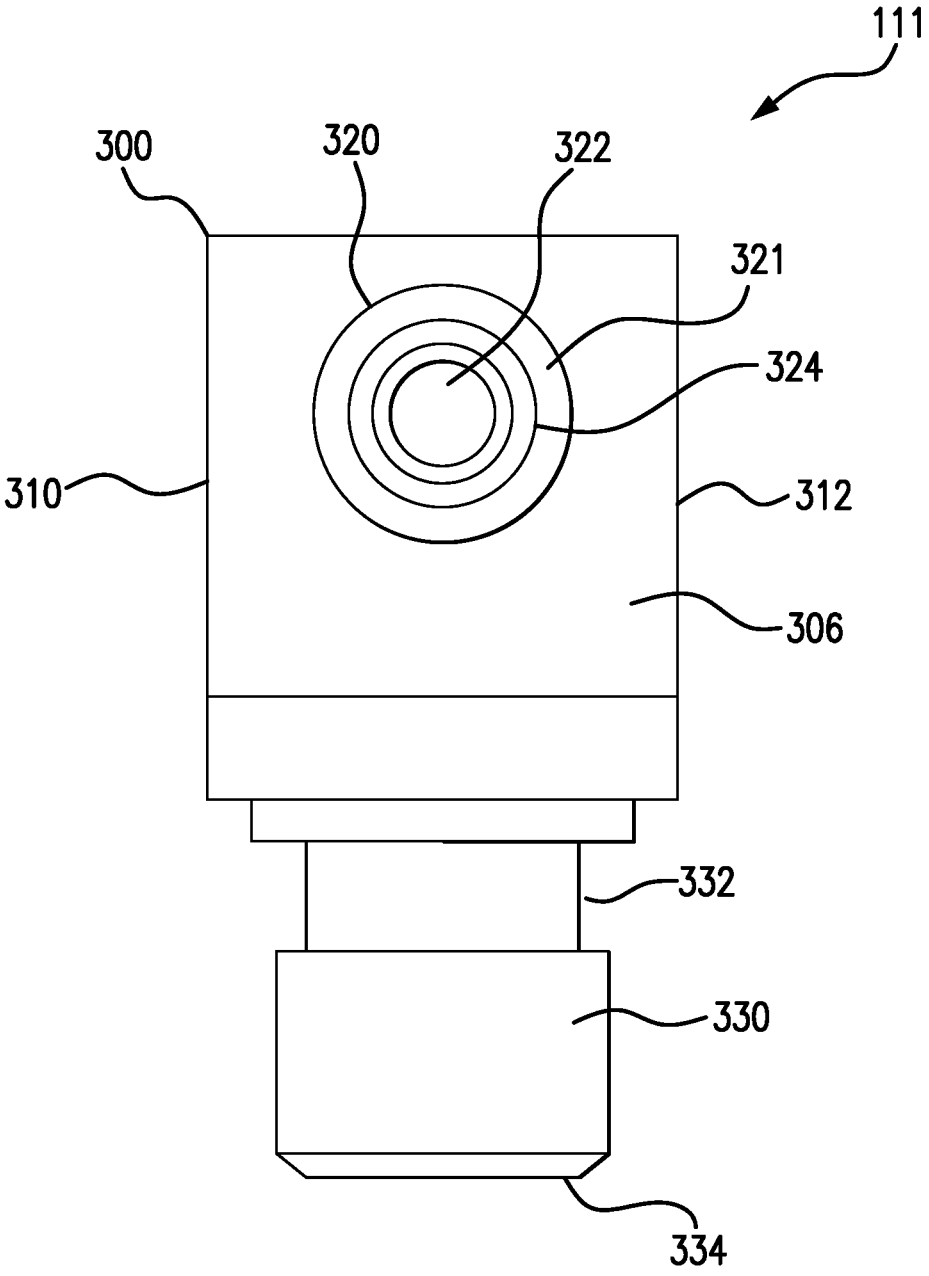
FIG. 4 is a front view of a connector housing according to one example.
Figure 5:
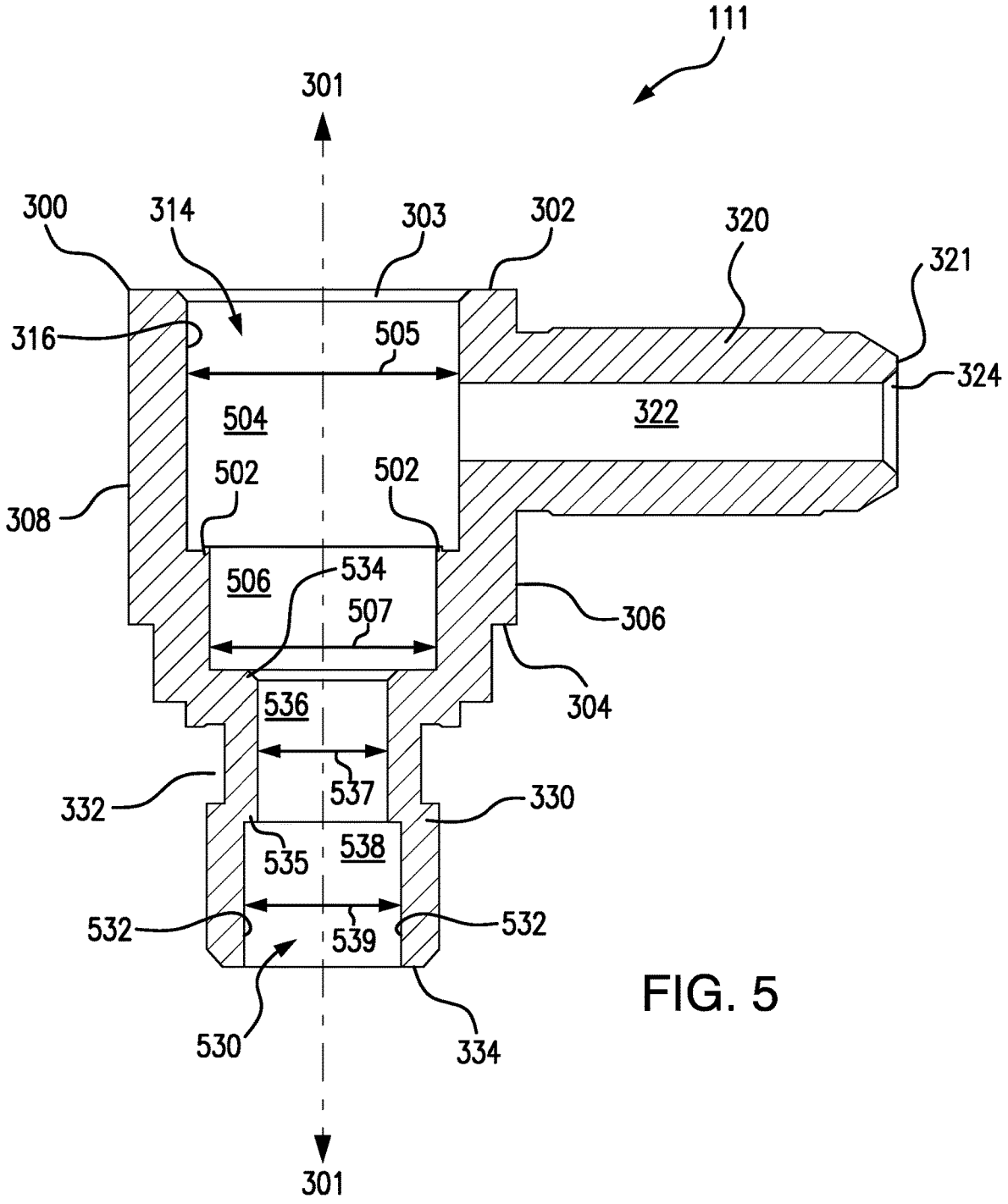
FIG. 5 is a side cross-sectional view of a connector housing taken along line B-B in FIG. 3 according to one example.

Referring to FIGS. 3-5, the connector housing 111 comprises a body 300 (e.g., a box-shaped body) that includes a top end 302, a bottom end 304, a front wall 306, a back wall 308, and a pair opposed side walls 310, 312, in which the front wall 306, back wall 308, and side walls 310, 312 extend from the top end 302 to the bottom end 304. As shown in FIGS. 3 and 5, the ends 302, 304 and the walls 308-312 of the body 300 defines a chamber 314 that extends along a central vertical axis 301 of the body 300.

A circular-shaped opening 303 is disposed along the top end 302 and opens into the chamber 314 of the body 300. The cap 115 is configured to be received in the opening 303 and removably coupled to the body 300 to enclose the chamber 314. The body 300 comprises an interior surface 316 that extends from the opening 303 at the top end 302 toward the bottom end 304.

In the non-limiting embodiment shown in FIG. 5, the body 300 comprises a shoulder 502 projecting away from the interior surface 316 toward the central vertical axis 301 of the body 300 such that the chamber 314 includes a first region 504 extending from the shoulder 502 to the opening 303 and a second region 506 extending from the shoulder 502 to the bottom end 304. In some embodiments, the first region 504 of the chamber 314 comprises a first transverse dimension 505 (e.g., diameter of the first region 504), and the second region 506 of the chamber 314 comprises a second transverse dimension 507 (e.g., diameter of the second region 506), in which the first transverse dimension 505 is greater than the second transverse dimension 507.

Figure 13:
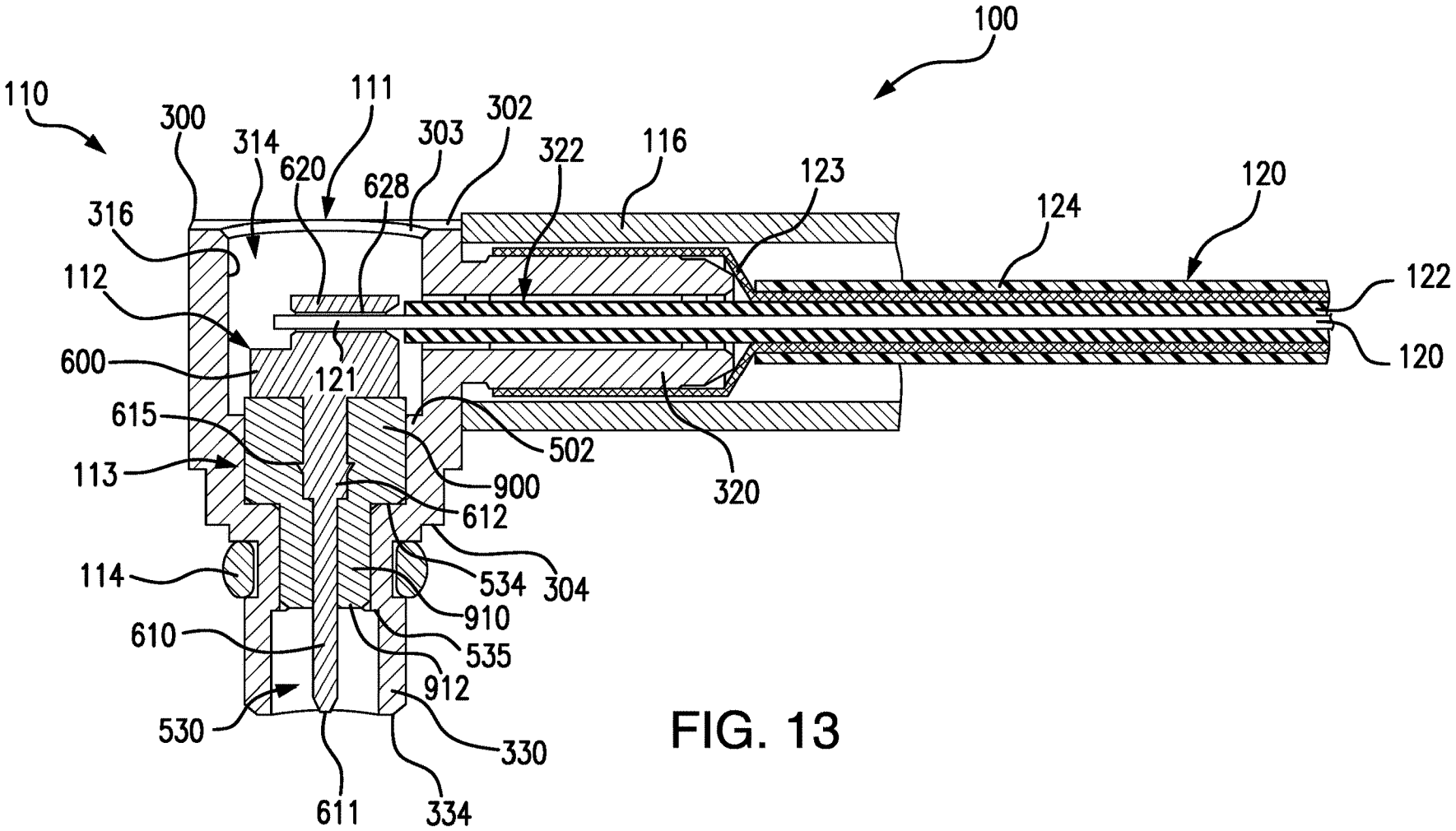
FIG. 13 is a side cross-sectional view of the connector assembly taken along line D-D in FIG. 11 according to one example.

Referring to FIGS. 3 and 4, the connector housing 111 comprises a tubular-shaped arm 320 projecting outward from the front wall 306 of the body 300. As shown in FIG. 5, the arm 320 comprises an opening 324 disposed at a distal end 321 of the arm. The arm 320 comprises a passage 322 extending along the longitudinal axis of the arm 320 from the opening 324 and opens into the first region 504 of the chamber 314 of the body 300 such that the passage 322 extends transverse to the central vertical axis 301 of the body 300. In the non-limiting illustrative embodiment, the diameter of the passage 322 remains constant throughout the length of the arm 320, and the length of the diameter is selected so that the insulating sleeve 122 and conductor core 202 may be received in the passage 322. As shown in FIG. 13, when the coaxial cable 120 is connected to the connector 110, the insulating sleeve 122 and the conducting core 202 are inserted into the passage 322 of the arm 320, and the second segment of the cable shield 123 is received around an exterior surface of the arm 320.

The connector housing 111 comprises a leg 330 projecting away from the bottom end 304 of the body 300 such that a longitudinal axis of the leg 330 is aligned with the central vertical axis 301 of the body 300. The leg 330 comprises an annular groove 332 disposed around the exterior surface of the leg 330. Referring to FIGS. 1, 3-5, and 11, the groove 332 is sized to receive the annular-shaped retainer 114 such that the retainer 114 wraps around the leg 330 of the connector housing 111. In some embodiments, the retainer 114 is comprised of a spring material (e.g., BeCu or Phosphorus Bronze) such that retainer 114 may be inserted into the groove 332 by stretching the retainer 114 to the orientation of the groove 332.

As shown in FIG. 5, a passage 530 extends along the longitudinal axis of the leg 330 and opens into the second region 506 of the chamber 314 of the body 300. In the non-limiting illustrative embodiment shown in FIG. 5, the second region 506 of the chamber 314 extends past the end wall 304 and into the leg 330. The leg 330 comprises an interior surface 532 extending along the second passage 530 and into the second region 506 of the chamber 314. In some embodiments, the leg 330 comprises a first step surface 534 disposed where the second passage 530 opens into the second region 506 of the chamber 314 and a second step surface 535 disposed along the second passage 530 below the first step surface 534. As shown in FIG. 5, the first and second step surfaces 534, 535 project away from the interior surface 532 toward the longitudinal axis of the leg 330, such that the passage 530 includes a first region 536 extending from the first step surface 534 to the second step surface 535 and a second region 538 extending from the second step surface 535 to a distal end 334 of the leg 330. In some embodiments, the first region 536 of the passage 530 comprises a first transverse dimension 537 (e.g., diameter of the first region 536), and the second region 538 of the passage 530 comprises a second transverse dimension 539 (e.g., diameter of the second region 538), in which the first transverse dimension 537 is greater than the second transverse dimension 539.

In some embodiments, the body 300, the arm 320, and the leg 330 of the housing 111 are comprised of a metallic material to provide rigidity for the connector 110. In some embodiments, the body 300, the arm 320, and the leg 330 may be formed out of a single piece of metallic material to form the housing 111. In some embodiments, the body 300, the arm 320, and the leg 330 may be combined as multiple pieces to form the housing 111.

In the non-limiting illustrative embodiment, the arm 320 is oriented at an angle of about 90° with respect to the leg 330 such that the connector 110 provides a right angle connection to the terminating end of the coaxial cable 120. In other embodiments (not shown), the arm 320 may be oriented at other angles (e.g., 45°) with respect to the leg 330 without departing from the scope of the present disclosure.

Figure 6:
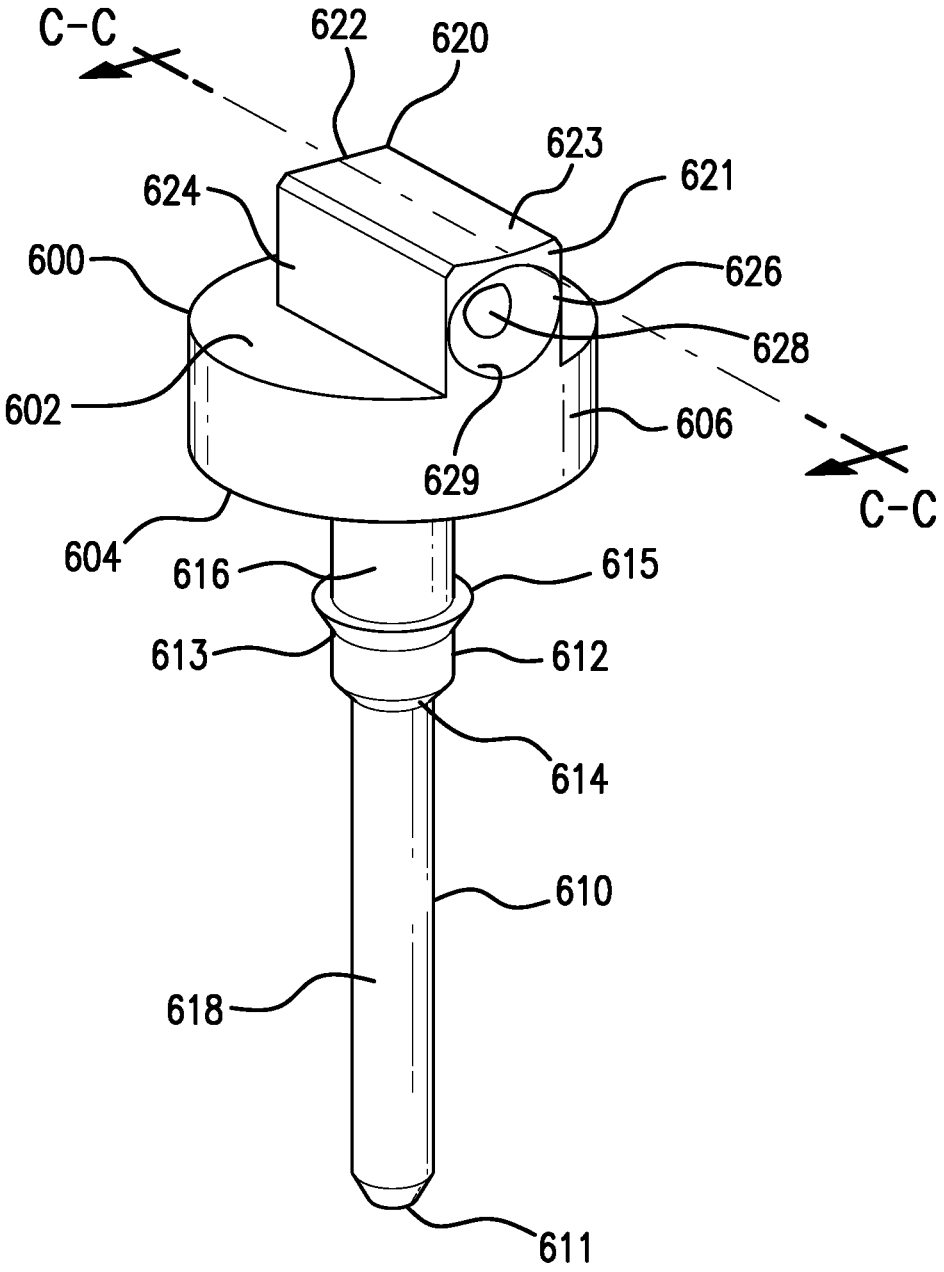
FIG. 6 is a perspective view of a signal contact according to one example.
Figure 7:
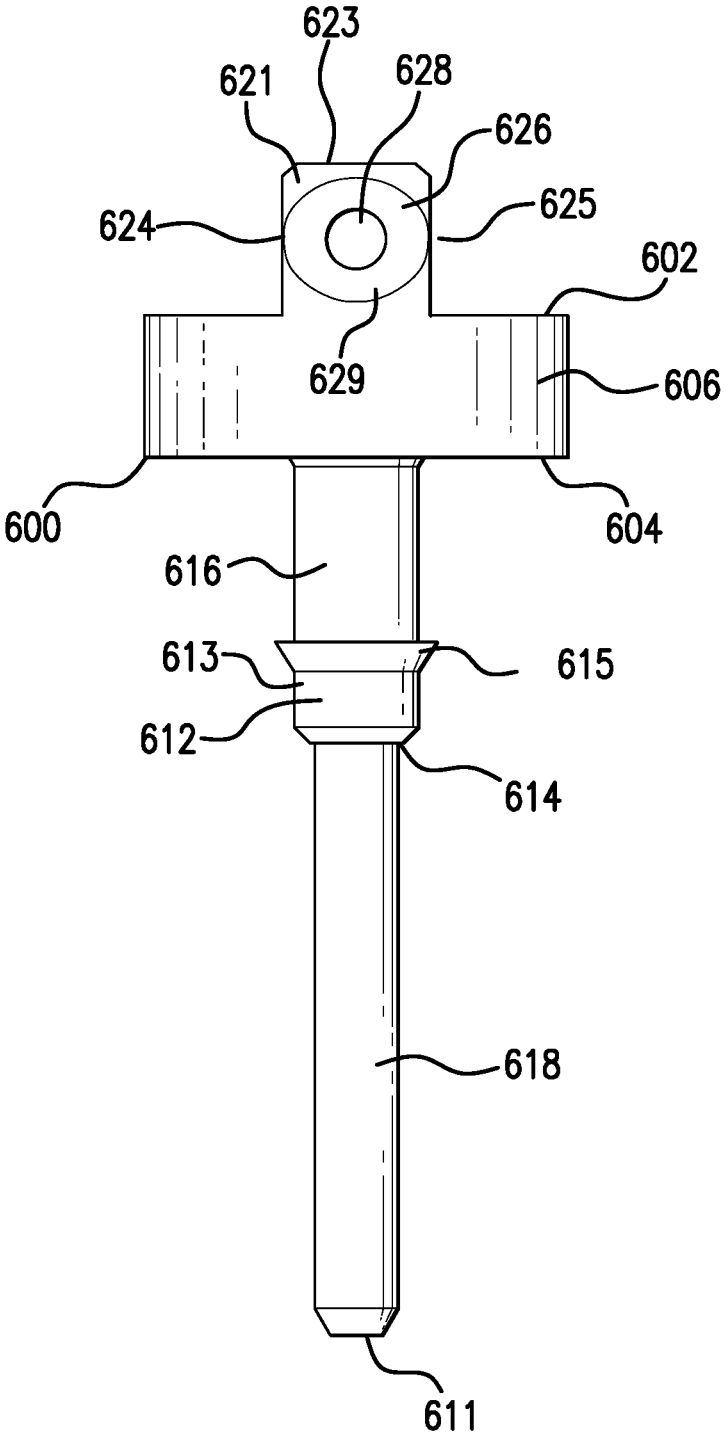
FIG. 7 is a front view of a signal contact according to one example.
Figure 8:
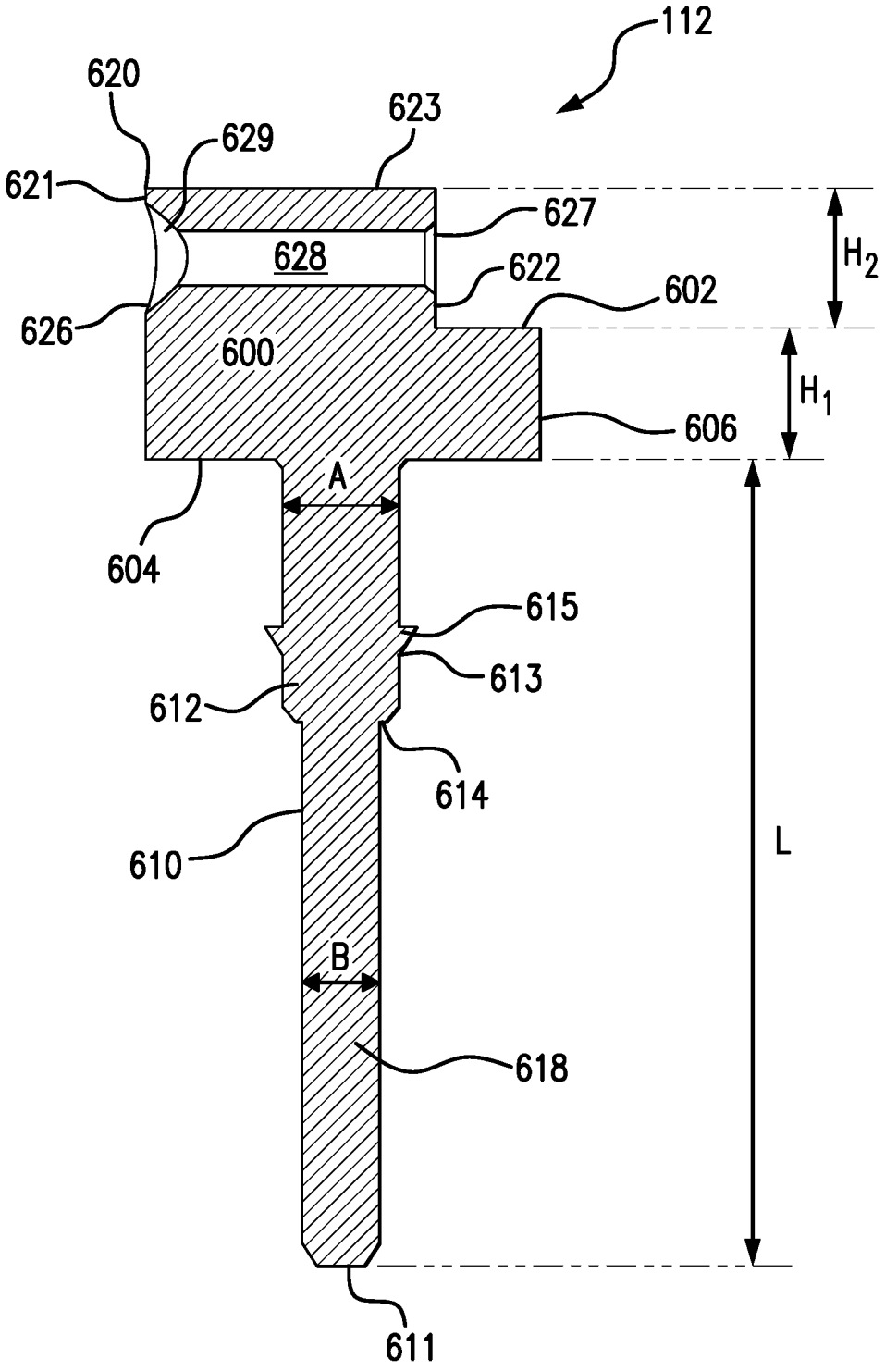
FIG. 8 is a side cross-sectional view of a signal contact taken along line C-C in FIG. 6 according to one example.
Figure 14:
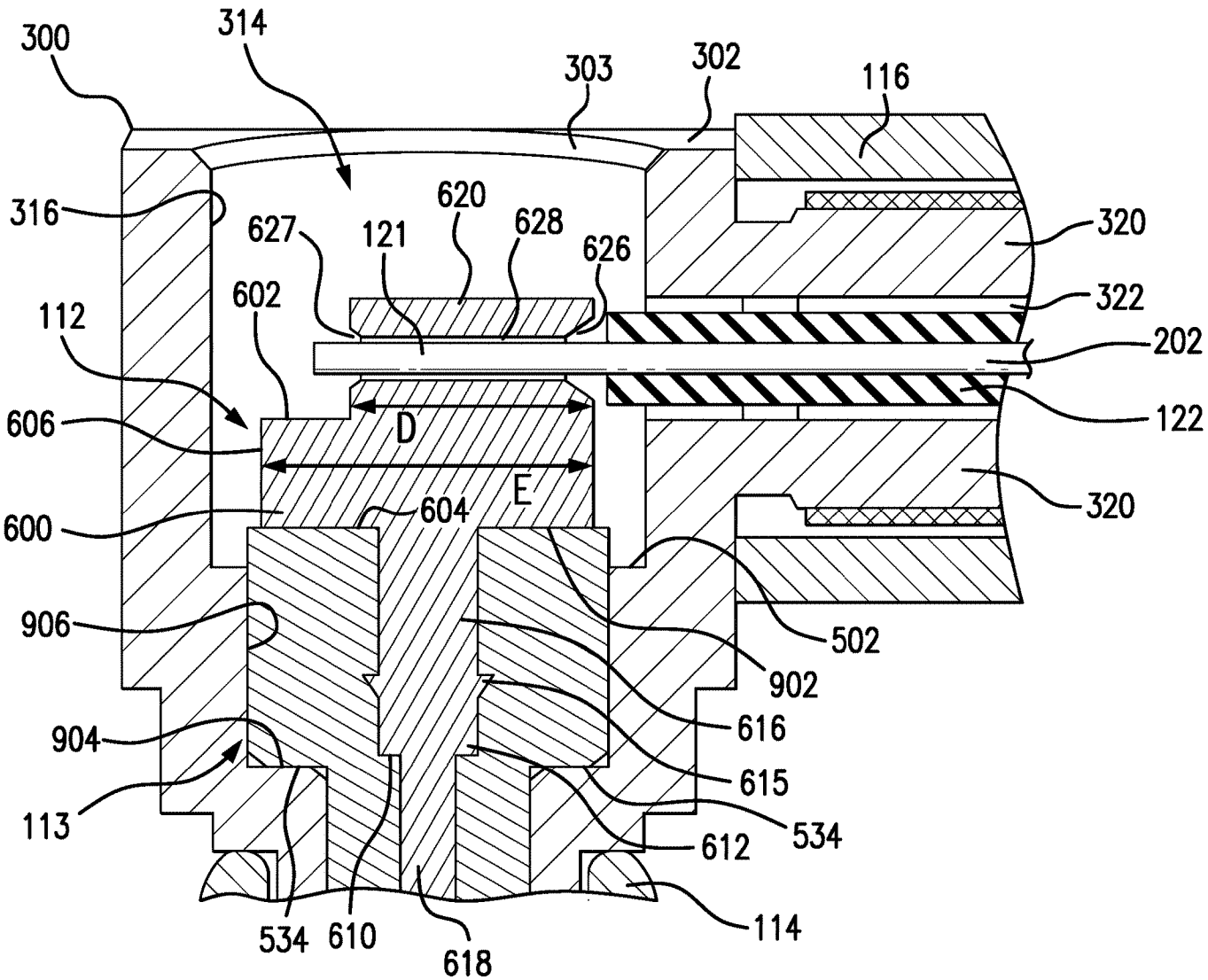
FIG. 14 is a partial cross-sectional view of the connector assembly with the cap omitted according to one example.

Referring to FIGS. 6-8, in one embodiment, the signal contact 112 comprises a disc-shaped head 600 that includes a top face 602, a bottom face 604 opposed to the top face 602, and a circumferential side wall 606 extending from the top face 602 to the bottom face 604. In other embodiments (not shown), the head 600 may include other shapes (e.g., rectangular, square, hexagon). As shown in FIGS. 13 and 14, the signal contact 112 is received in the connector housing 111 such that the head 600 is disposed in the first region 504 of the chamber 314 and the side wall 606 of the head 600 is spatially separated from the interior surface 316 of the body 300.

Referring to FIGS. 6-8, the signal contact 112 comprises a pin 610 projecting away from the bottom face 604 of the head 600 in an axial direction (e.g., a direction perpendicular to the bottom face 604), where the bottom face 604 projects beyond pin 610 in a transverse, or radial direction. The signal contact 112 comprises a collar 612 disposed along the pin 610 and a flange 615 disposed at a first end 613 of the collar 612. As shown in FIGS. 6-8, the collar 612 and the flange 615 extend around the pin 610 and project away from the exterior surface of the pin 610 in a radial direction, where the flange 615 projects beyond the collar 612. In the non-limiting illustrative embodiment, the pin 610 comprises a first portion 616 extending from the flange 615 to the bottom face 604 of the head 600 and a second portion 618 extending from a second end 614 of the collar 612 to a distal end 611 of the pin 610. As shown in FIG. 8, the pin 610 has a longitudinal dimension L, which corresponds to the length from the bottom face 604 of the head 600 to the distal end 611. In some embodiments, the longitudinal dimension L is about 0.175 inches (e.g., for MMCX type connector). In some embodiments, as shown in FIG. 8, the first portion 616 of the pin 610 comprises a first transverse dimension A, and the second portion 618 of the pin 610 comprises a second transverse dimension B such that the first portion 616 projects beyond the second portion 168 in the transverse, or radial direction. In some embodiments, the first transverse dimension A is about 0.025 inches, and the second transverse dimension B is about 0.016 inches (e.g., for MMCX type connector). As shown in FIGS. 13 and 14, the signal contact 112 is received in the connector housing 111 such that the pin 610 extends through the passage 530 of the leg 330, where the distal end 611 of the pin 610 is proximate to the distal end 332 of the leg 330.

Referring to FIGS. 6-8, the signal contact 112 comprises a ferrule member 620 projecting from the top face 602 of the head 600 in an axial direction (e.g., a direction perpendicular to the top face 602), where the top face 602 projects beyond the ferrule member 620 in a transverse, or radial direction. As shown in FIG. 6, in the non-limiting embodiment, the ferrule member 620 is box-shaped and comprises a front end wall 621, a back end wall 622, a top end wall 623 extending from the front end wall 621 to the back end wall 622, and a pair of opposed lateral walls 624, 625 extending from the top end wall 623 to the top face 602 of the head 600 and from the front end wall 621 to the back end wall 622. Referring to FIGS. 6 and 8, the front end wall 621 projects from the periphery of the top face 602 such that the circumferential sidewall 606 and the front end wall 621 form a continuous surface. The back end wall 622 is disposed inward from the periphery of the top face 602 such that the top face 602 extends beyond the back end wall 622 in a radial or transverse direction. That is, in one embodiment, the length of the ferrule member is less than the diameter of the head 600.

Figure 15:
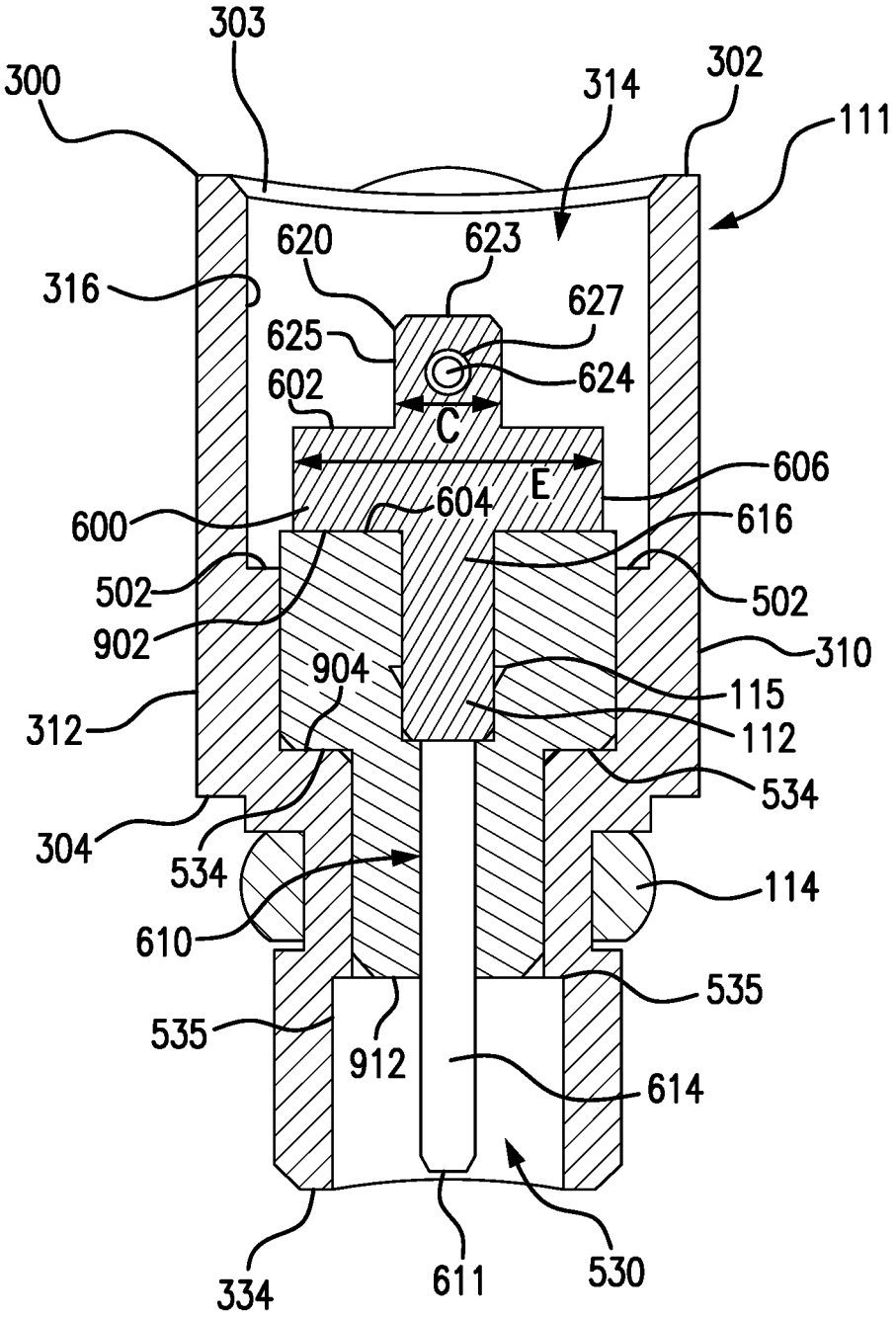
FIG. 15 is a back cross-sectional view of the connector assembly taken along line E-E in FIG. 11 according to one example.

Referring to FIGS. 14 and 15, the ferrule member 620 has a lateral transverse dimension C, which corresponds to the width defined between the opposed lateral walls 624, 625, a longitudinal transverse dimension D, which corresponds to the length defined between the front and back end walls 621, 622. The head 600 comprises a transverse dimension E, which corresponds to the width or diameter of the front and bottom faces 602, 604. Referring to FIG. 8, the head 600 has a height dimension H1, which corresponds to the height extending from the top face 602 to the bottom face 604. In some embodiments, the height H1 is about 0.028 inches (e.g. for MMCX type connector). Referring to FIG. 8, the ferrule member 620 has a height dimension H2, which corresponds to the height between the top end wall 623 and top face 602 of the head 600. In some embodiments, the height H2 is about 0.03 inches (e.g. for MMCX type connector).

As shown in FIG. 14, in one embodiment, the longitudinal transverse dimension D of the ferrule member 620 is less than the transverse dimension E of the head 600. In other embodiments (not shown), the longitudinal transverse dimension D of the ferrule member 620 may be substantially equal to the longitudinal transverse dimension E of the head 600. As shown in FIG. 15, in one embodiment, the lateral transverse dimension C of the ferrule member 620 is less than the transverse dimension E of the head 600. In some embodiments, the lateral transverse dimension C of the ferrule member 620 ranges from about 0.025 inches to 0.075 inches. In some embodiments, the longitudinal transverse dimension D of the ferrule member 620 ranges from about 0.0425 inches to 0.085 inches. In some embodiments, the longitudinal transverse dimension E of the head 600 ranges from about 0.05 inches to 0.20 inches.

By extending beyond the ferrule member 620 in the transverse direction, either in the lateral direction or both in the lateral direction and the longitudinal direction, the head 600 is configured to distribute at least some of the force received from the ferrule member 620 during a crimping process in a transverse direction. For example, when force is applied axially against the ferrule member 620 in the direction in which pin 610 extends away from the bottom face 604 of head 600, the head 600 redistributes some of that applied force in a direction transverse to the direction in which pin 610 extends away from the bottom face 604 of head 600, thereby providing sufficient support for the ferrule member 620 during the crimping process.

As shown in FIGS. 6-8, the ferrule member 620 comprises a first cavity 626 disposed at the front end wall 621, a second cavity 627 disposed at the back end wall 622, and a passage 628 extending between the first cavity 626 and the second cavity 627. In non-limiting illustrative embodiment, the diameter of the passage 628 is smaller than the diameter of the first and second cavities 626, 627. The first cavity 626 recedes into the ferrule member 620 such that a conical surface 629 extends from an opening of the first cavity 626 to an opening of the passage 628. The length of the diameter of the passage 628 is selected to receive the terminating portion 121 of the conducting core 202. As shown in FIG. 13, when the terminating portion 121 of the conducting core 202 is connected to the connector 110, the terminating portion 121 is inserted through the first cavity 626 and into the passage 628 of the ferrule member 620. The shape of the first cavity 626, in particular the conical surface 629, allows the terminating portion 121 to be easily received in the passage 628, thereby promoting the terminating portion 121 of the conducting core 202 to be inserted further into the ferrule member 620.

In the non-limiting embodiment shown in FIGS. 6-8, the ferrule member 620 is integrated with the head 600 and the pin 610 of the signal contact 112 such that the head 600, the pin 610, and the ferrule member 620 are formed out of a single piece of a conductive material. In other non-limiting embodiments (not shown), the head 600, the pin 610, and the ferrule member 620 may be combined as multiple pieces to form the signal contact 112. In various embodiments, the signal contact 112 is comprised of a conducting material (e.g., copper, gold) such that the signal contact 112 is capable of establishing an electrical link with the conducting core 202 of the coaxial cable 120.

Figure 9:
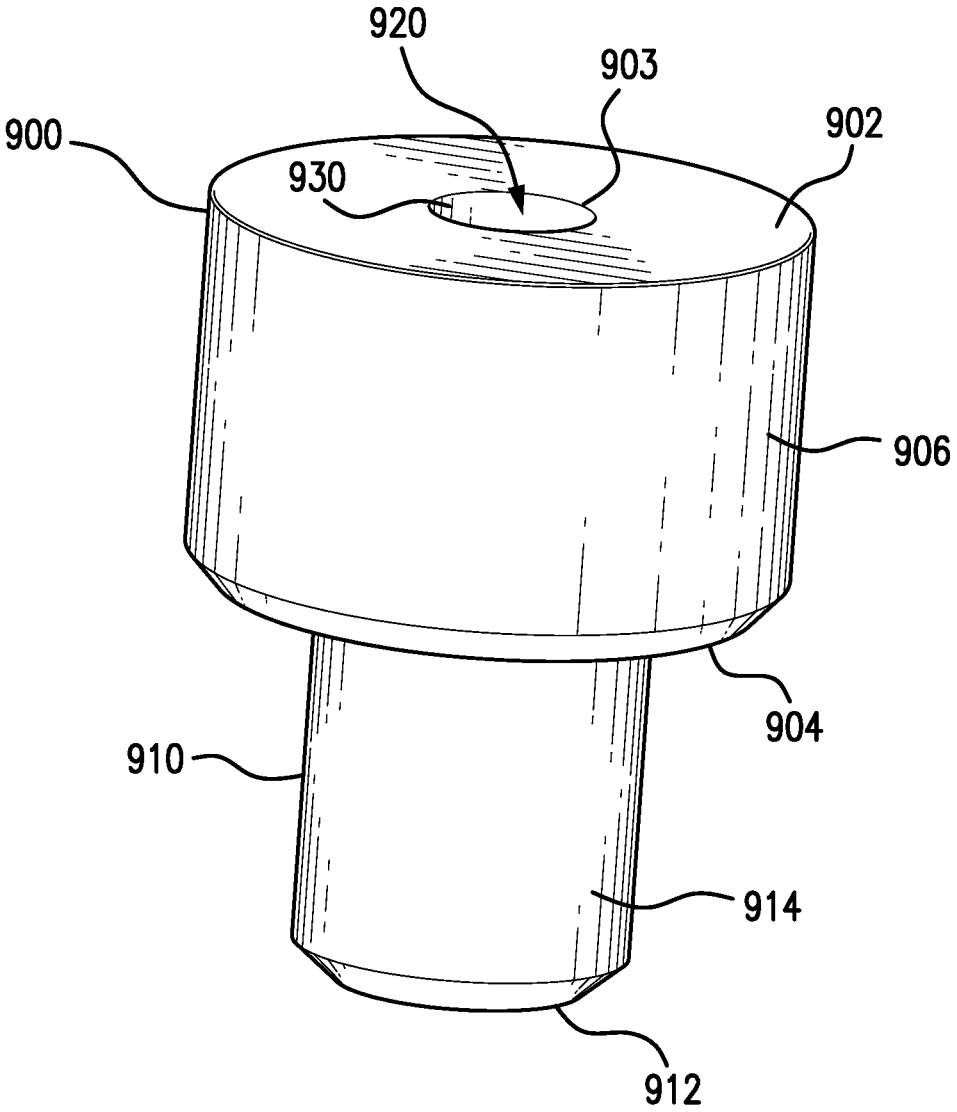
FIG. 9 shows a perspective view of a dielectric according to one example.
Figure 10:
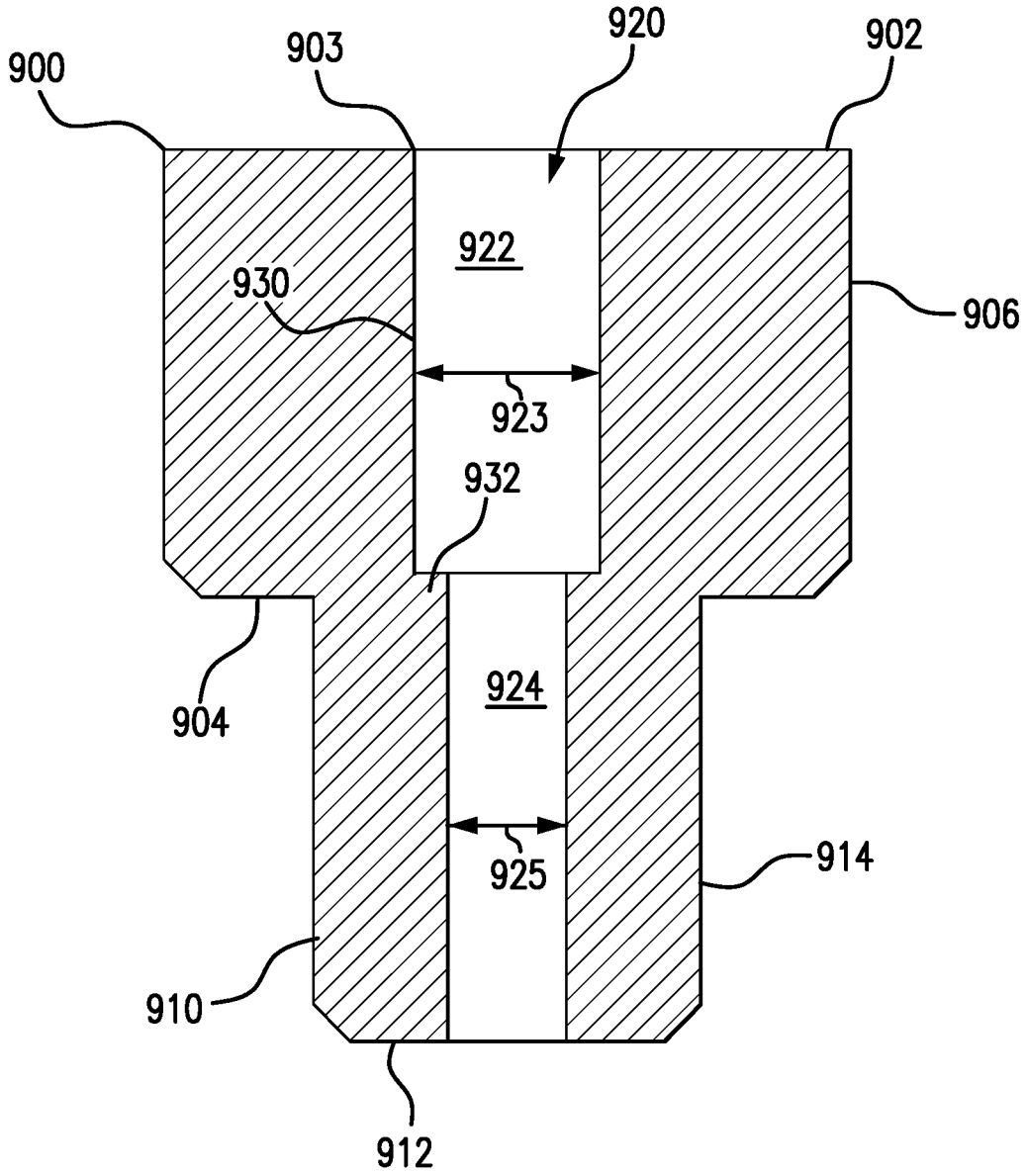
FIG. 10 is a cross-sectional view of a dielectric according to one example.
Figure 11:
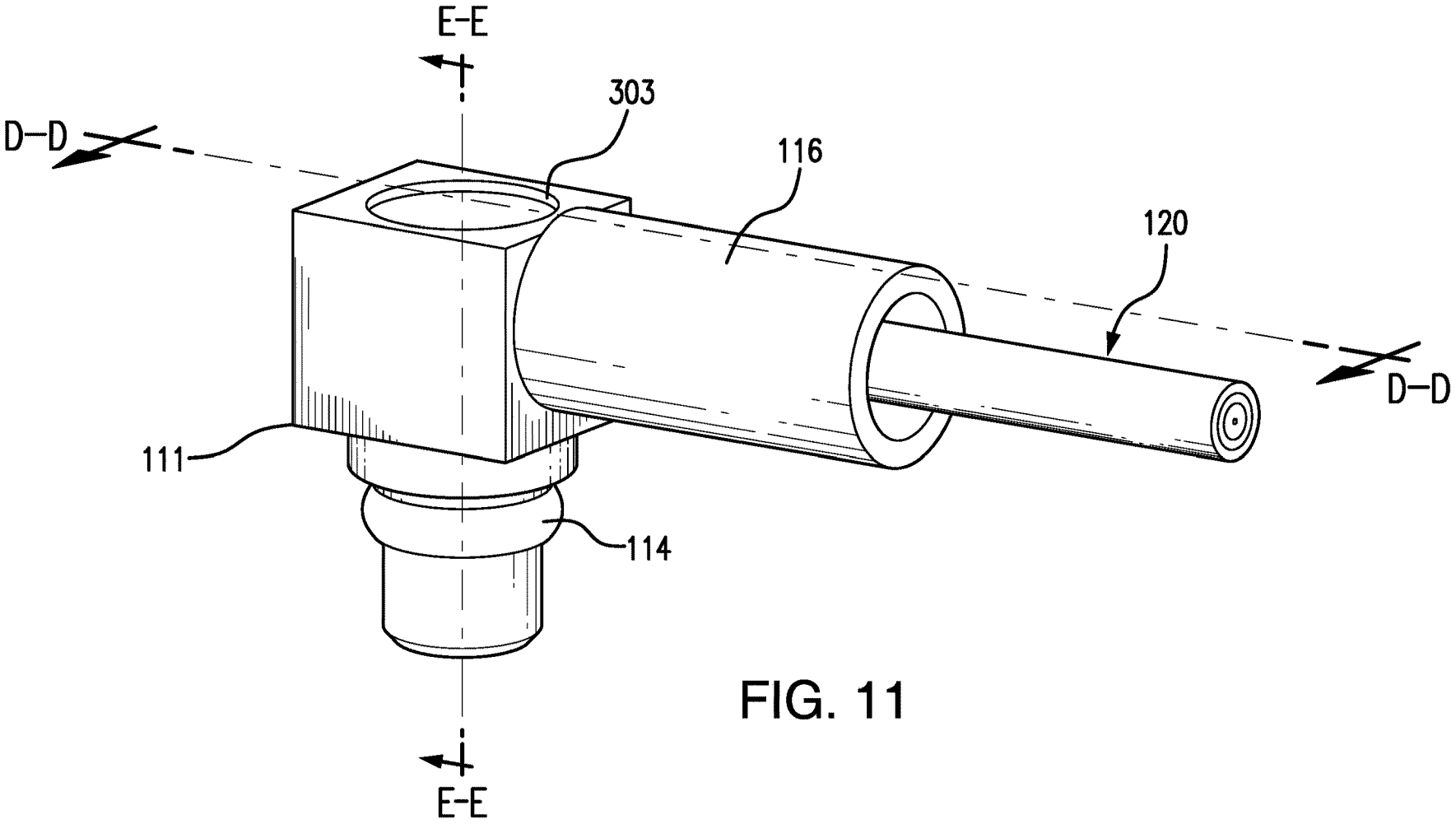
FIG. 11 is a perspective view of a connector assembly with the cap omitted according to one example.

Referring to FIGS. 9 and 10, the dielectric 113 comprises a cylindrical-shaped plug 900 comprising a top face 902, a bottom face 904, and a circumferential sidewall 906 extending from the top face 902 to the bottom face 904. The dielectric 113 comprises a cylindrical-shaped neck 910 projecting away from the bottom face 904 of the plug 900 in an axial direction (e.g., a direction perpendicular to the bottom face 904), where the bottom face 904 projects beyond pin neck 910 in a transverse, or radial direction. The neck 910 terminates at distal end 912 and comprises a circumferential sidewall 914 extending from the distal end 912 to the bottom face 904 of the plug 900.

As shown in FIGS. 9 and 10, the dielectric 113 comprises an opening 903 disposed at the top face 902 of the plug 900, an opening 913 disposed at the distal end 912 of the neck 910, and a passage 920 extending from the opening 903 at the top face 902 to the opening 913 at the distal end 912. Referring to FIG. 10, the dielectric 113 comprises an interior surface 930 circumventing the passage 920 and a step-surface 932 projecting away from the interior surface 930 such that the passage 920 includes a first region 922 extending from the step-surface 932 to the opening 903 at the top face 902 and a second region 924 extending from the step-surface 932 to the opening 913 at the distal end 912. In some embodiments, the first region 922 of the passage 920 comprises a first transverse dimension 923 (e.g., diameter of the first region 922), and the second region 924 of the passage 920 comprises a second transverse dimension 925 (e.g., diameter of the second region 924), in which the first transverse dimension 923 is greater than the second transverse dimension 925. In the illustrative non-limiting embodiment, the step-surface 932 is disposed proximately where the neck 910 projects from the bottom face 904 such that the first region 922 of passage 920 corresponds to the plug 900 and the second region 924 of the passage 920 corresponds to the neck 910.

In the non-limiting embodiment shown in FIGS. 6-8, the plug 900 is integrated with the neck 910 of the dielectric 113 such that the plug 900 and the neck 910 are formed out of a single piece of a dielectric material. In other non-limiting embodiments (not shown), the plug 900 and the neck 910 may be combined as multiple pieces to form the dielectric 113. In various embodiments, the dielectric 113 is comprised of a dielectric material, (e.g., polyetherimide, such as Ultem™; or polyetheretherketone, such as PEEK™). The material for the dielectric 113 is selected so that the dielectric 113 may provide sufficient support against signal contact 112 to withstand axial force applied by a punch during a crimping process.

FIGS. 11-15 show various views of a non-limiting embodiment of the connector assembly 100, in which the coaxial cable 120 is connected to the connector 100. The signal contact 112 and the dielectric 113 are received in the chamber 314 of the housing 111, where the dielectric 113 is configured to retain the signal contact 112 within the housing 111.

As shown in FIGS. 13-15, the dielectric 113 is disposed in the chamber 314 of the body 300 such that the bottom face 904 of the plug 902 abuts against the first step surface 534 of the leg 330. The neck 910 of the dielectric 113 extends into the first region 536 of the passage 530, where the distal end 912 of the neck 910 is about flush with the second step surface 535 of the leg 330. The transverse dimension 537 of the first region 536 of the passage 530 is selected to correspond to the diameter of the neck 910 so that the sidewall 914 of the neck 910 engages the interior surface 532 of the leg 330 along the second region 536 of the passage 530, thereby securing the dielectric 113 within the housing 111. The plug 900 of the dielectric 113 extends along the second region 506 and into the first region 504 of the chamber 314, where the top face 902 of the plug 900 is disposed above the shoulder 502 of the body 300. The transverse dimension 507 of the second region 506 of the chamber 314 is selected to correspond to the diameter of the plug 900 so that the sidewall 906 of the plug 900 engages the interior surface 316 of the body 300 along the second region 506 of the chamber 314, thereby providing support against the dielectric 113 in the radial direction.

The signal contact 112 is maintained in the chamber 314 of the housing 111 by inserting the pin 610 through the opening 903 at the top face 902 of the plug 900 and into the passage 920 of the dielectric 113. Referring to FIGS. 13 and 14, the pin 610 is disposed in the passage 920 of the dielectric 113 such that the second end 614 of the collar 612 abuts against the step-surface 932 of the dielectric 113. The second portion 618 of the pin 610 extends through the second region 924 of the passage 920 and the opening 913 at the distal end 912 of the neck 912, where the distal end 611 of the pin 610 is disposed proximately to the distal end 334 of the leg 334. The transverse dimension 925 of the second region 924 of the passage 920 is selected to correspond to the transverse dimension B of the second portion 618 such that the second portion 618 of the pin 610 engages the interior surface 930 of the dielectric 113 along the second region 924 of the passage 920, thereby providing an interference fit between the pin 610 and the neck 910. The first portion 616 of the pin 610 extends along the first region 922 of the passage 920, where the flange 615 projects into interior surface 930 of the dielectric 113. By projecting into the interior surface 930 of the dielectric 113, the flange 615 ensures that the pin 610 remains secured within the passage 920 of the dielectric 113. The transverse dimension 923 of the first region 922 of the passage 920 is selected to correspond to the transverse dimension A of the first portion 616 such that the first portion 616 of the pin 610 engages the interior surface 930 of the dielectric 113 along the first region 922 of the passage 920, thereby providing an interference fit between the pin 610 and the neck 910.

As shown in FIGS. 13-15, the bottom face 604 of the head 600 of the signal contact 112 rests on top face 902 such that the dielectric 113 provides support against the head 600 of the signal contact 112. In the non-limiting embodiment shown in FIGS. 13-15, the diameter of the plug 900 is selected to be equal to or greater than the diameter of the head 600 to provide support along the entire surface area of bottom face 604 of the head 600. Accordingly, the interference fit between the pin 610 and the dielectric 113 along passage 920 and the support provided against head 600 ensure that the signal contact 112 is secured within the chamber 314 of the housing 111, even when significant amount of pressure is applied against the signal contact 112 during a crimping process.

Figure 12:
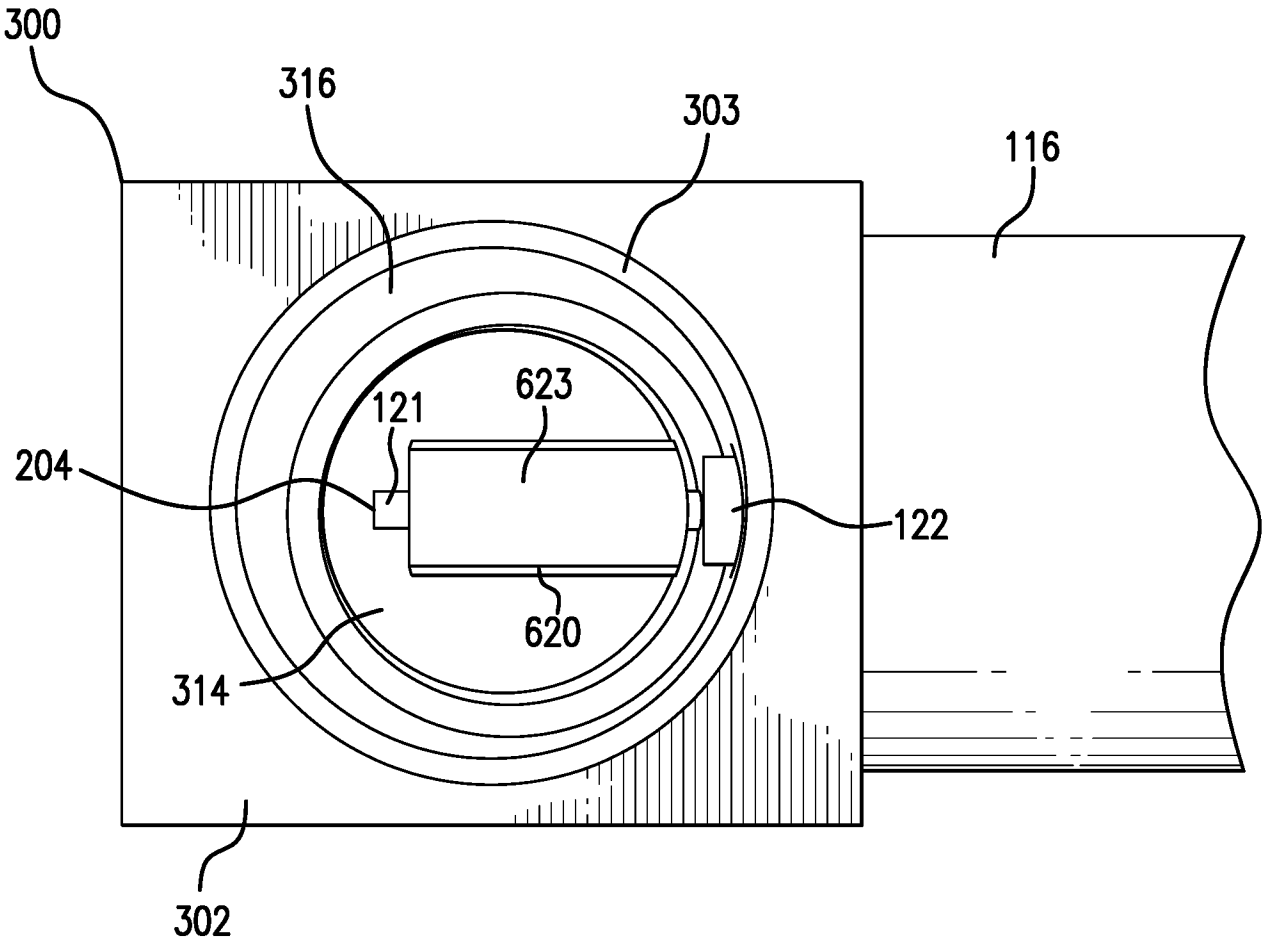
FIG. 12 is a partial top view of the connector assembly with the cap omitted according to one example.

Referring to FIGS. 12-15, the ferrule member 620 is disposed in the first region 504 of the chamber 314, where the first cavity 626, the second cavity 627, and passage 628 of the ferrule member 620 are aligned with the passage 320 and the opening 321 of the arm 320. When the coaxial cable 120 is positioned on the connector 110, the terminating portion 121 conducting core 202 extends through the passage 320 of the arm 320 and the cavity 626 of the ferrule member 620, where the terminating portion 121 extends into the passage 628 of the ferrule member 620. The transverse dimension 505 of the first region 504 of the chamber 314 is selected so that the interior surface 316 of the body 300 is spatially separated from the walls 621-625 of the ferrule member 620, thereby providing a gap between the back end wall 622 of the ferrule member 620 and the interior surface 316 of the body 300. To properly position the coaxial cable 120 on the connector 110, the terminating portion 121 of the conducting core 202 may be pulled through the passage 628 of the ferrule member 620, where the distal end 204 of the terminating portion 121 protrudes through the second cavity 627 at the back end wall 622. As shown in FIG. 12, in determining whether the coaxial cable 102 is properly positioned on the connector 110 for a crimping process, one may look through the opening 303 of the body 300 and examine whether the distal end 204 of the terminating portion 121 protrudes through the second cavity 627 and extends into the gap between the back end wall 622 and the interior surface 316 of the body 300.

In an exemplary embodiment, the connector 110 is fastened to the coaxial cable 120 by crimping the ferrule member 620 to the terminating portion 121 of the conducting core 202 and crimping the ferrule tube 116 to the arm 320 of the connector housing 111. Once the terminating portion 121 is received in the passage 628 of the ferrule member 620 of the signal contact 112 (shown in FIGS. 12-14), the ferrule member 620 is crimped on the terminating portion 121, thereby securely fastening the conducting core 121 to the signal contact 112. Once the second segment of the cable shield 123 is positioned around the arm 320 of the connector housing 111, the ferrule tube 116 is placed on the cable shield 123 (shown in FIG. 11), and the ferrule tube 116 is crimped on the arm 320 of the connector housing 111, thereby securely fastening the coaxial cable 120 to the connector housing 111. According to various embodiments, both the process of crimping the ferrule member 620 to the terminating portion 121 of the conducting core 202 and the process of crimping the ferrule tube 116 to the arm 320 of the connector housing 111 may be performed simultaneously in a single step.

Figure 16:
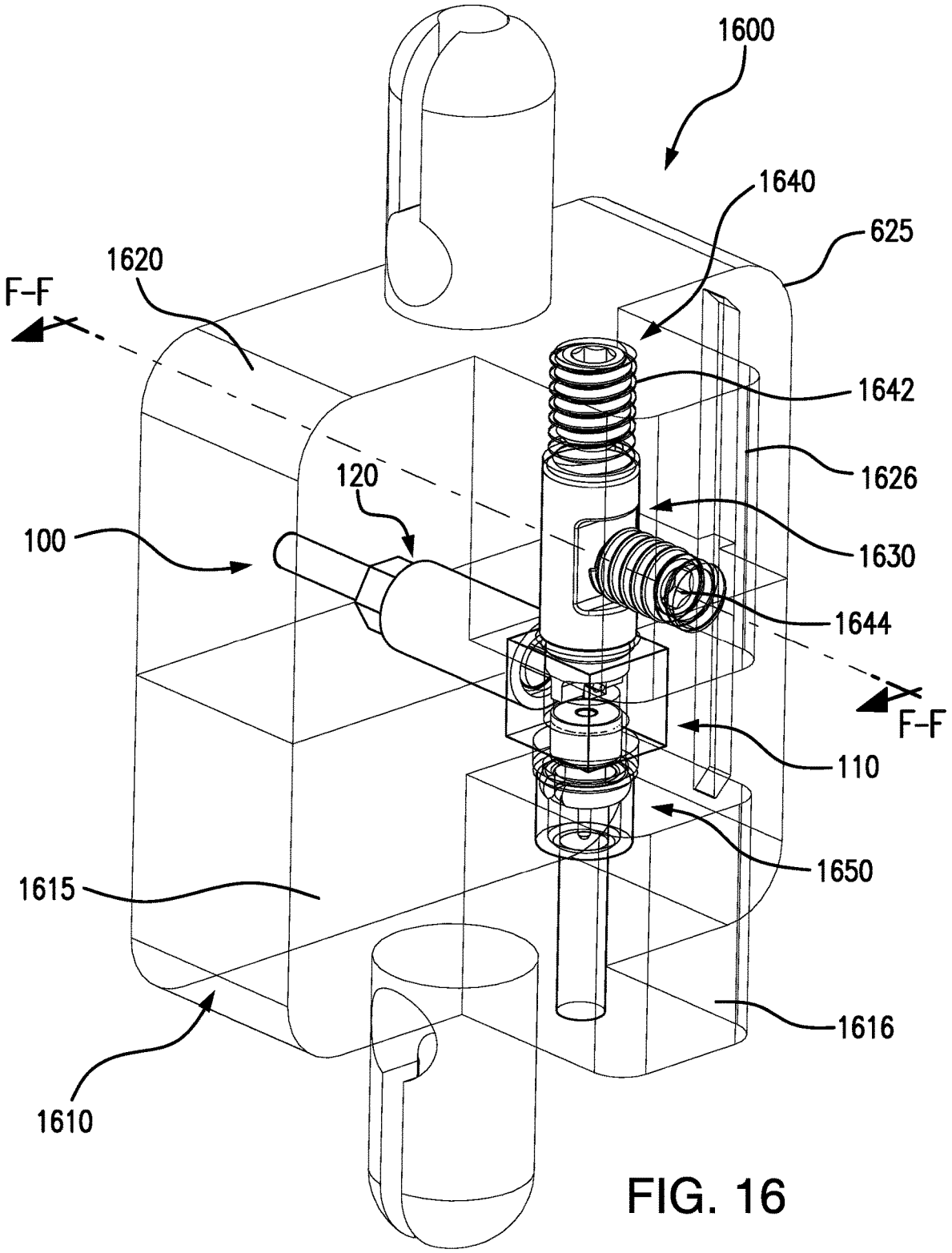
FIG. 16 is a perspective view of a die assembly and the connector according to one example.

According to various embodiments, a die assembly 1600 is configured to simultaneously crimp the ferrule member 620 to the terminating portion 121 of the conducting core 202 and the ferrule tube 116 to the arm 320 of the connector housing 111. In one non-limiting embodiment, shown in FIG. 16, the die assembly 1600 comprises a lower die member 1610, an upper die member 1620, a punch 1630, punch adjustor 1640, and a nest 1650. In FIG. 16, the lower die member 1610 and the upper die member 1620 are shown to be "transparent" so that the other components (e.g., the punch 1630, the punch adjustor 1640, and the nest 1650) may be seen through the lower and upper die members 1610, 1620.

Figure 17:
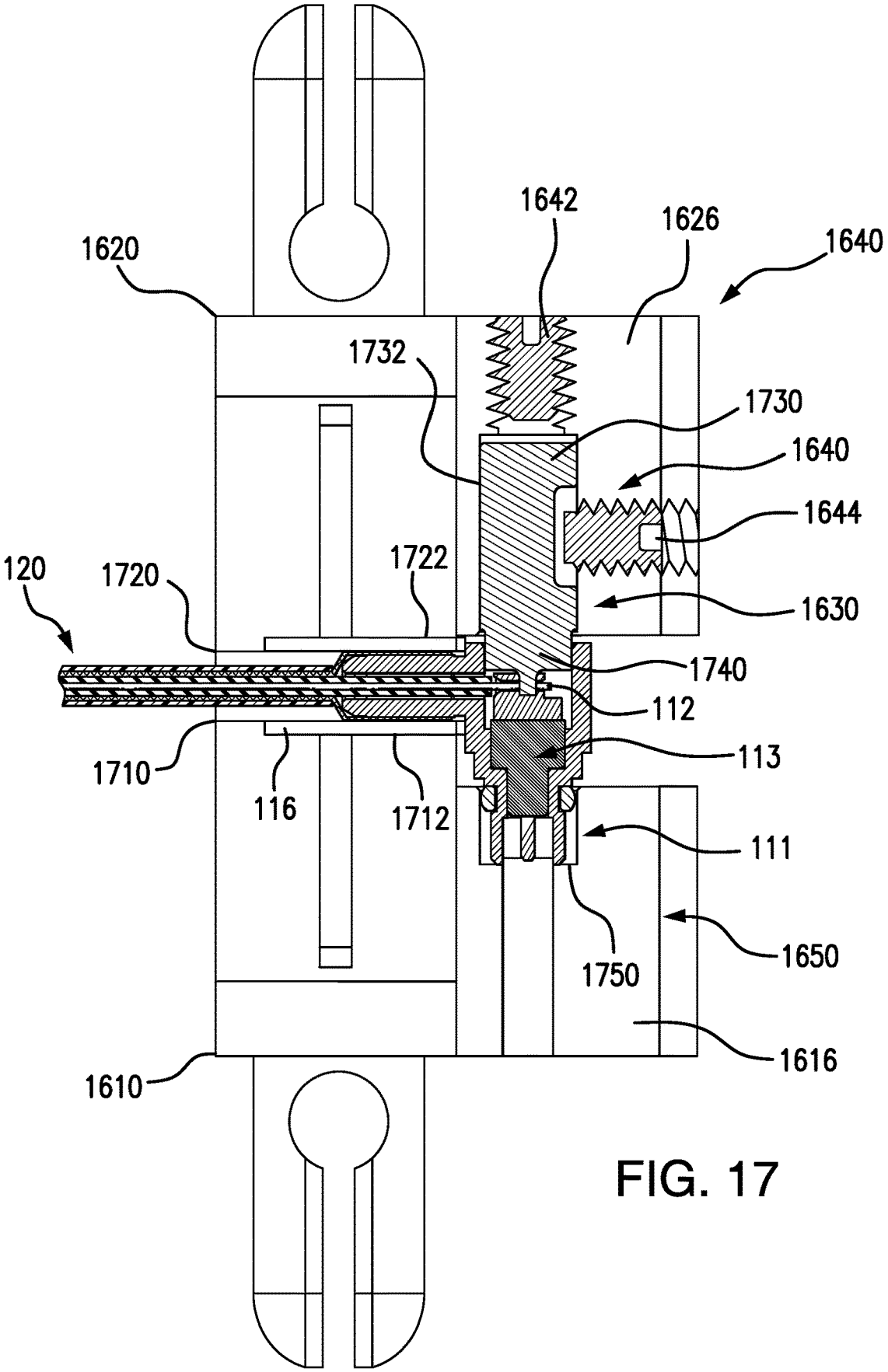
FIG. 17 is a side cross-sectional view of the die assembly and the connector taken along line F-F according to one example.

As shown in FIG. 17, the lower die member 1610 comprises a first engagement surface 1710, and the upper die member 1620 comprises a second engagement surface 1720, in which the first and second engagement surfaces 1710, 1720 are configured to abut each other during the crimping process. The lower die member 1610 comprises a first recess 1712 configured to partially circumvent the ferrule tube 116 (e.g., the lower half of the ferrule tube 116). The upper die member 1620 comprises a second recess 1722 configured to partially circumvent the ferrule tube 116 (e.g., the upper half of the ferrule tube 116). When the first and second engagement surfaces 1712, 1722 are engaged, the first recesses 1712 is aligned with the second recess 1722 so that the ferrule tube 116 fitted around the coaxial cable 110 may be received in the aligned first and second recesses 1712, 1722 between the lower and upper die members 1610, 1620. During the crimping process, the first and second recesses 1712, 1722 press against the ferrule tube 116 in opposing directions, thereby forming a crimp connection (e.g., hexagonal crimp) between the ferrule tube 116, the cable shield 123, and the arm 320 of the housing 111.

Referring to FIGS. 16 and 17, the punch 1630 and the punch adjustor 1640 are integrated with the upper die member 1620. As shown in FIG. 16, the upper die member 1620 comprises a protrusion 1626 projecting from a side 1625 thereof. The punch 1630 and the punch adjustor 1640 are housed in the protrusion 1626 such that the punch 1630 is configured to move in an axial direction toward and away from the lower die member 1610 by actuating the punch adjustor 1640. The punch adjustor 1640 comprises a crimp adjustment screw 1642 disposed above the punch 1630 and a lock adjustment screw 1644 disposed to a side of the punch 1630. The crimp adjustment screw 1642 is configured to control the depth of the punch 1630, and the lock adjustment screw 1644 is configured to secure the punch 1630 at a predetermined position along its axial movement.

Referring to FIGS. 16 and 17, the nest 1650 is integrated with the lower die member 1610. As shown in FIG. 16, the lower die member 1610 comprises a protrusion 1616 projecting from a side 1615 thereof. The nest 1650 comprises a blind hole 1750 extended into the protrusion 1616 of the lower die member 1610. The blind hole 1750 is configured to receive the leg 330 of the connector housing 111 to secure the connector 110 to the lower die member 1610. The protrusion 1616 of the lower die member 1610 is configured to be aligned with the protrusion 1626 of the upper die member 1620 when the first and second engagement surfaces 1712, 1722 are engaged. Accordingly, when the leg 330 of the connector housing 111 is received in the blind hole 1750 of the nest 150 and the ferrule tube 116 is received between the first and second recesses 1612, 1622, the punch 1630 is disposed directly above the opening 303 of the connector housing 111 and is configured to be lowered into the chamber 314 of the connector housing 111 to crimp the ferrule member 1620 of the signal contact 112.

Figure 18:
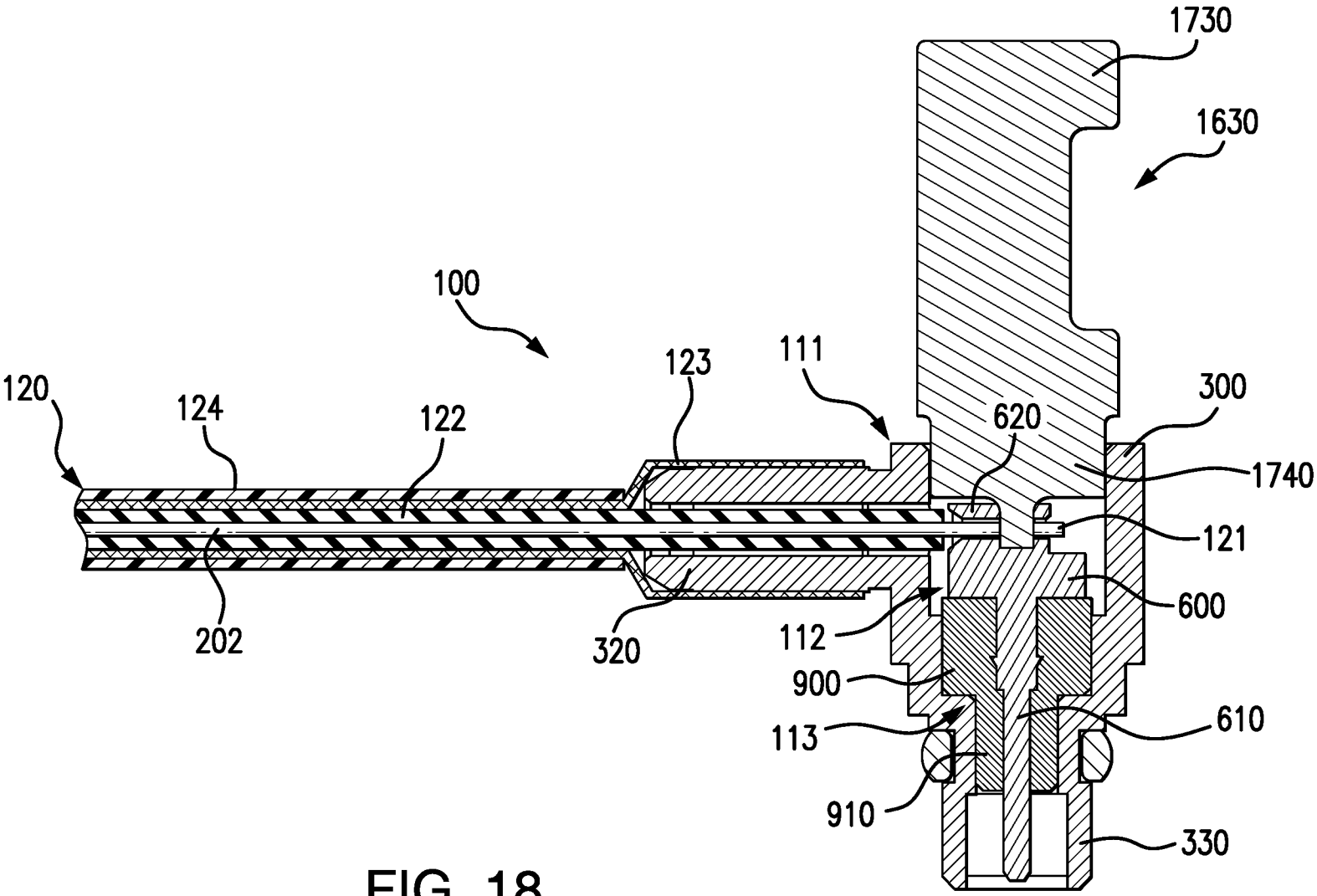
FIG. 18 is a side cross-sectional view of a punch and the connector according to one example.
Figure 19:
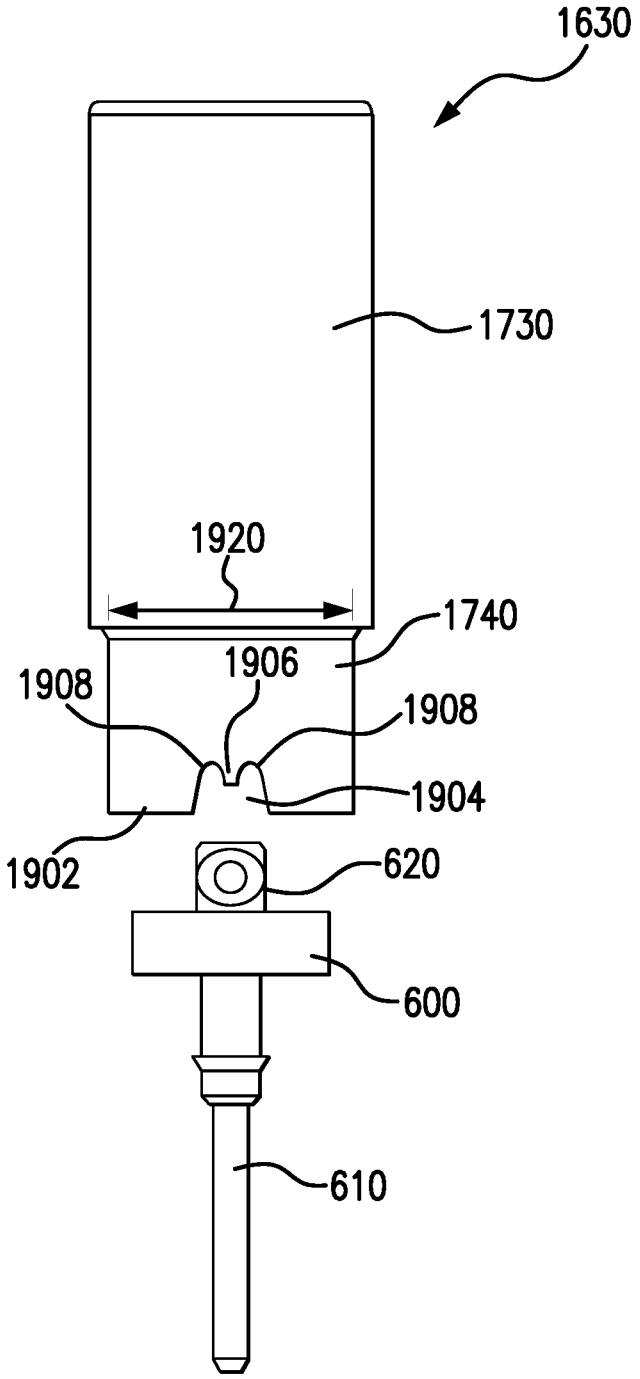
FIG. 19 is a front view of a punch and the contact according to one example.

Referring to FIGS. 17-19, the punch 1630 comprises a handle 1730 (e.g., column-shaped) and a blade 1740 projecting from an end of the handle 1730 in an axial direction. As shown in FIG. 17, the handle 1730 is received in a cavity 1732 of the protrusion 1626 of the upper die member 1620. The handle 1730 is configured to interface with the crimp adjustment screw 1642 and the lock adjustment screw 1644 to control the axial movement of the punch 1630, ultimately allowing one to control the depth of the crimp.

As shown in FIG. 19, the blade 1740 comprises a crimping edge 1902 and a notch 1904 disposed along the crimping edge 1902 and extending toward the column handle 1730. In the non-limiting illustrative embodiment, the blade 1740 comprises a tooth 1906 disposed along the crimping edge 1902 and projecting into the notch 1904 away from the handle 1730 to define a "B crimp," in which the crimping edge 1902 includes a pair of concave surfaces 1908. The pair of concave surfaces 1908 and the tooth 1906 are configured to press against the ferrule member 620 during the crimping process to form a B-shaped crimped connection between the ferrule member 620 and the terminating portion 121. In other embodiments (not shown), the blade 1740 may include crimping edges that define other shapes to form various types of crimping connections.

Referring to FIG. 19, the blade 1740 comprises a transverse dimension 1920 that corresponds to the transverse dimension 504 of the first region 504 of the chamber 314. Accordingly, during a crimping process, the blade 1740 of the punch 1630 is configured to be inserted through the opening 303 disposed at the top end wall 302 of the housing 111 and press against the ferrule member 1620 of the signal contact 112.

Figure 20:
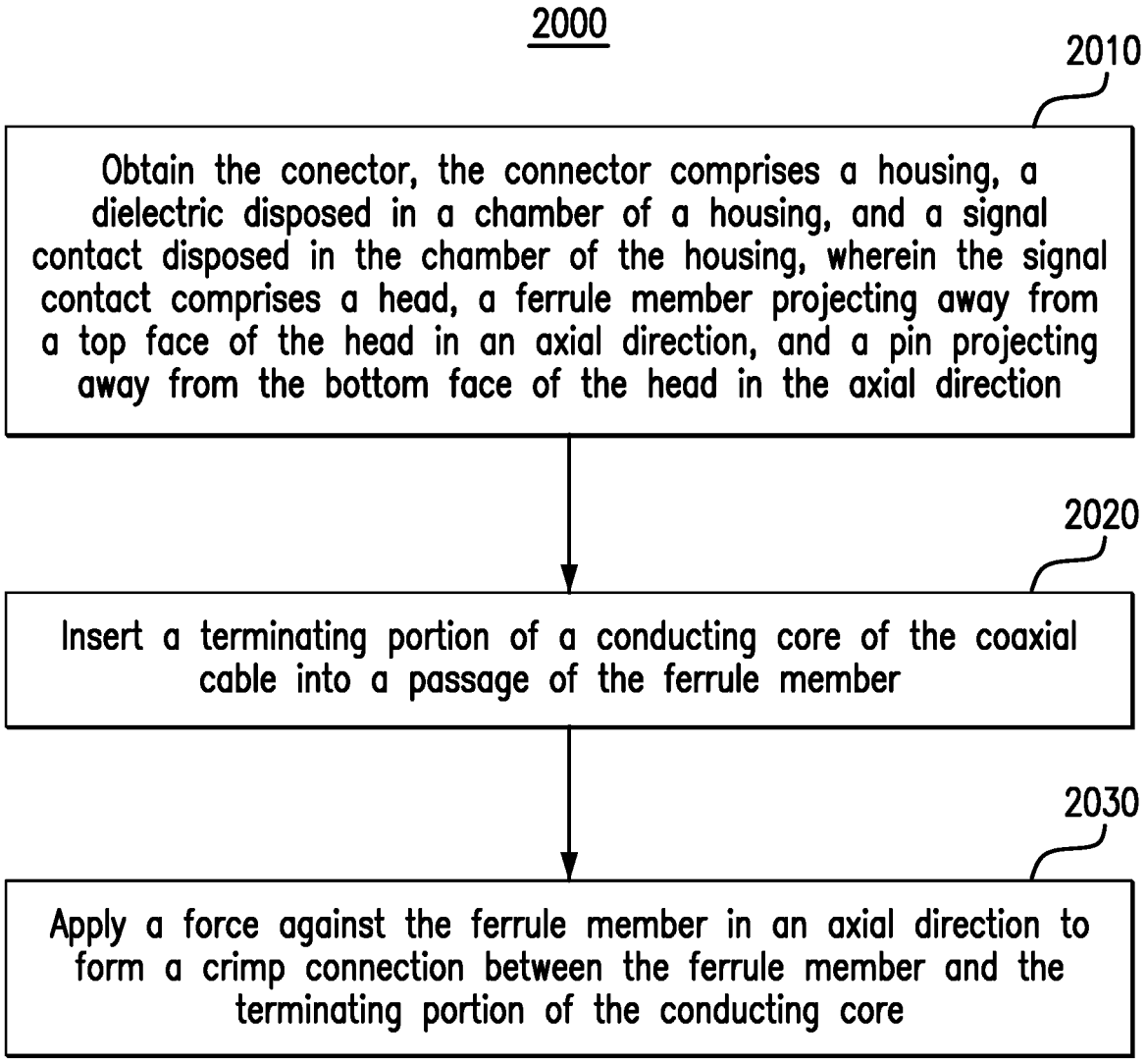
FIG. 20 is a flow chart of an example method for crimping a coaxial cable having a conducting core to a connector having a housing, a signal contact, and a dielectric.

According to various embodiments, FIG. 20 illustrates a method 2000 for establishing a crimped connection between the coaxial cable 120 and the connector 100. The method 2000 comprises a step 2010 of obtaining the signal contact 112 in the chamber 314 of the housing 111. In some embodiments, step 2010 may further comprise obtaining the dielectric in the chamber 314 of the housing 314 and inserting the pin 610 of the signal contact 112 into the passage 920 of the dielectric 113. The method 200 may comprise a step of inserting the terminating portion 121 of the conducting core 202 into the passage 628 of the ferrule member 620. In some embodiments, step 2020 further comprises positioning the terminating portion 121 such that the distal end 204 of the terminating portion 121 protrudes out of the second cavity 627 and beyond the back end wall 622 of the ferrule member 620.

Figure 22:
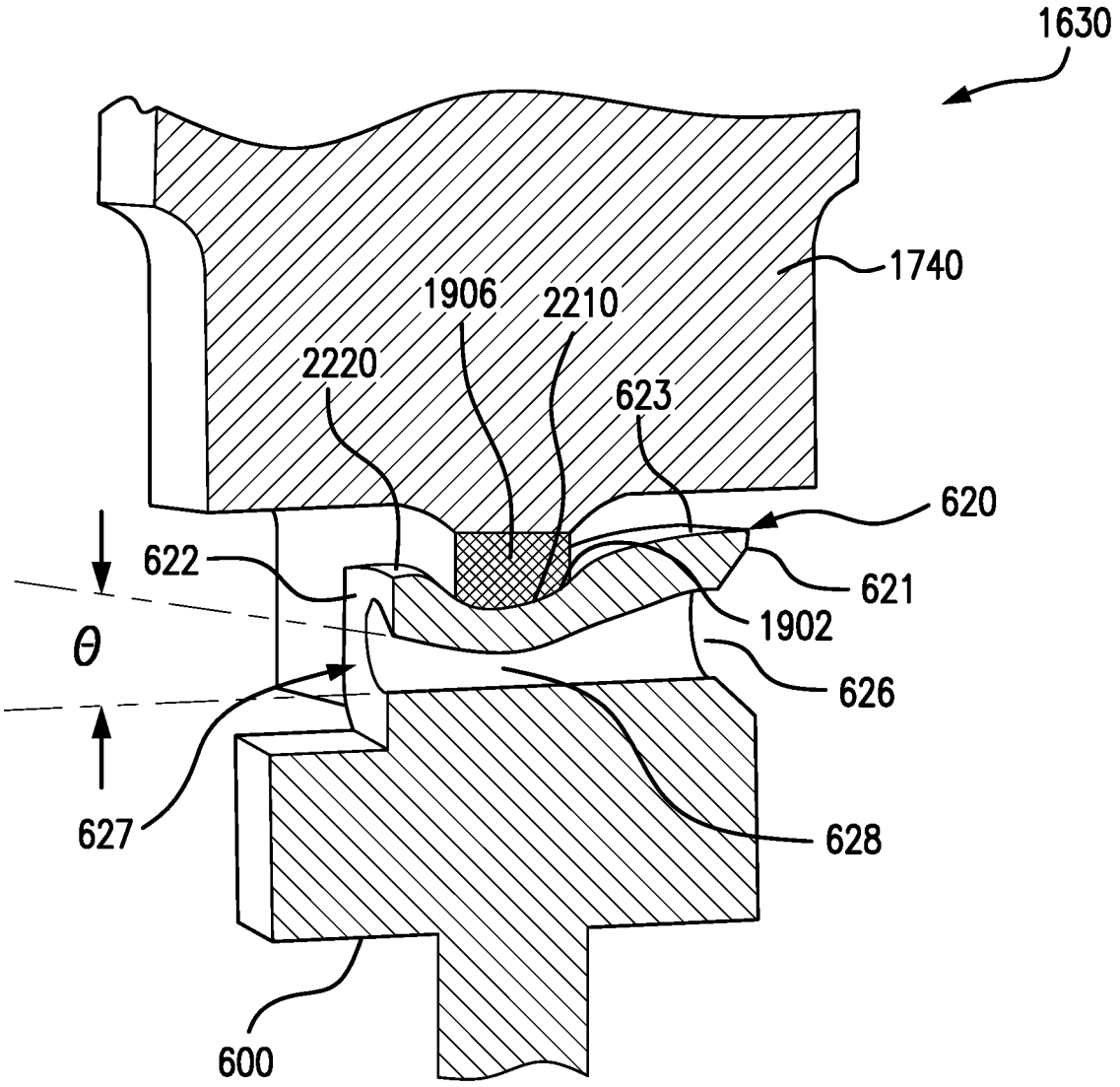
FIG. 22 is a partial cross-sectional view of a punch crimping a ferrule member of a signal contact according one example.

The method 2000 comprises a step 2030 of applying force against the ferrule member 620 in an axial direction (i.e., the direction opposite to the direction in which ferrule member 602 extends from the top face 602 of head 600) to form a crimp connection between the terminating portion 121 of the conducting core 202 and the ferrule member 620. In the present context, crimp connection or crimped refers to the joining of two or more pieces of metal or other ductile material by deforming one or both of them to hold the other. In some embodiments, step 2030 includes applying the force by the punch 1630 such that the concave surfaces 1908 and the tooth 1906 disposed along the crimping edge 1902 of the blade 1740 are pressed against the top end wall 623 and the lateral walls 624, 625 of the ferrule member 620. As shown in FIG. 22, the length of the ferrule member 620 is greater than the width of the tooth 1906 such that the tooth 1906 presses and deforms only a first portion 2210 of the top end wall 623 of the ferrule member 620. The first portion 2210 of the top end wall 623 protrudes toward the base 600, thereby crimping the ferrule member 620 to the terminating portion 121. Along the first portion 2210 of the top end wall 623, the diameter of the passage 628 is reduced such that the ferrule member 620 is intimately contacting the terminating portion 121 of conducting core 202. Because the tooth 1906 contacts only the first portion 2210 of the top end wall 623, remaining portions of the top end wall 623 (e.g. a second portion 2220) proximate to the front and back end walls 621, 622 remain substantially intact. Accordingly, the first portion

2210 of the top end wall 623 is oriented an angle $\theta_S$ with respect to the second portion 2220 of the top end wall 623 such that ferrule member 620 minimizes localized stress on the terminating portion 121 of the conducting core 202 where the terminating portion 121 protrudes past the second cavity 627 of the ferrule member 620. Providing minimal stress where the terminating portion 121 of the conducting core 202 protrudes out of the second cavity 627 enhances the tensile strength of the crimped ferrule member 620. In the process of applying force, the blade 1740 of the punch 1630 is inserted through the opening 503 of the housing 111. In some embodiments, step 2030 includes controlling the depth of the crimp connection between the terminating portion 121 and the ferrule member 620 by using the crimp adjustment screw 1642 integrated with the upper die member 1620.

Figure 21:
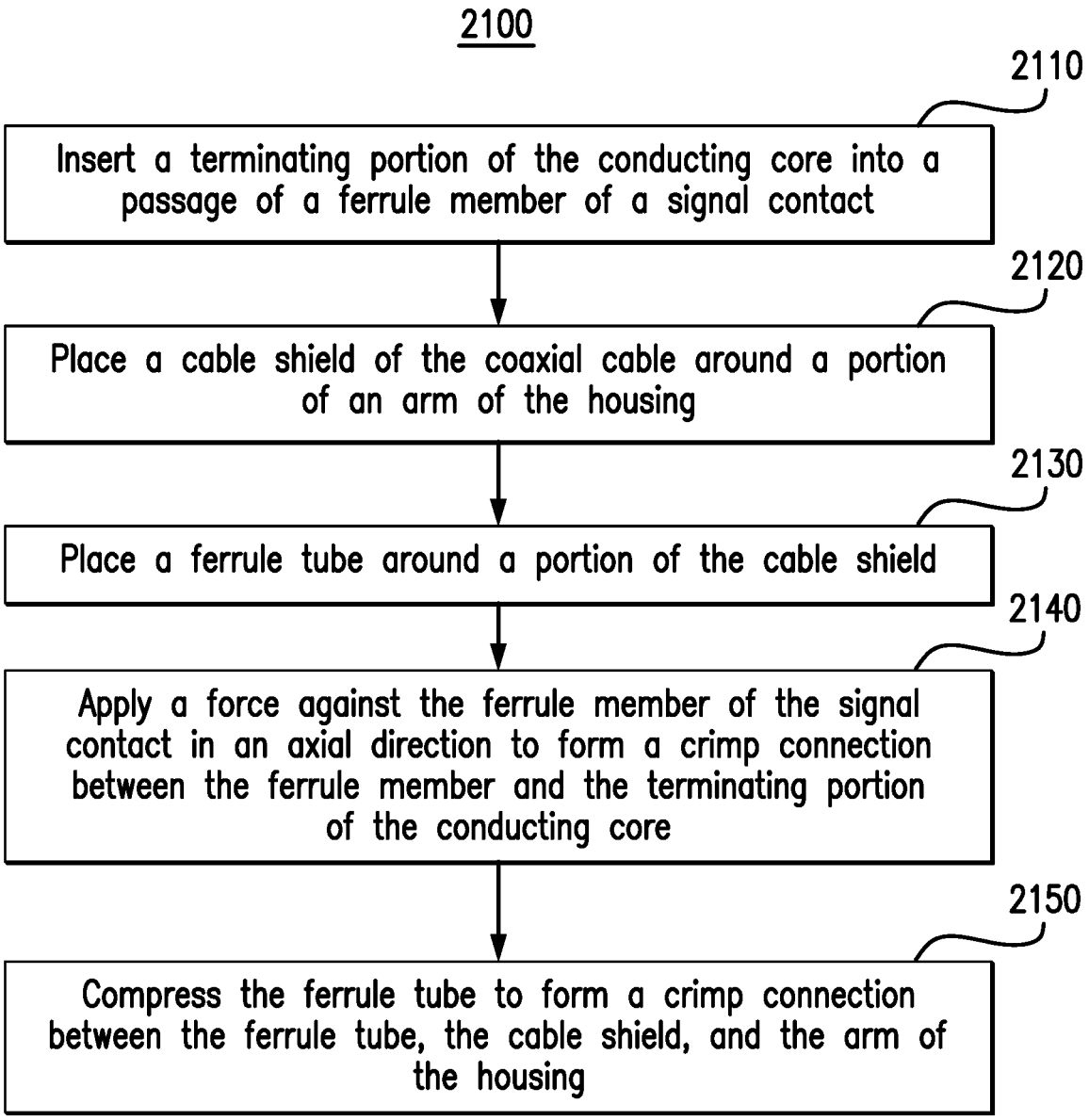
FIG. 21 is a flow chart of an example method for crimping a coaxial cable having a conducting core to a connector having a housing, a signal contact, and a dielectric.

According to various embodiments, FIG. 21 illustrates a method 2100 for establishing a crimped connection between the coaxial cable 120 and the connector 100. The method 2100 comprises a step 2110 of inserting the terminating portion 121 of the conducting core 202 into the passage 628 of the ferrule member 620 of the signal contact 112. Similar to step 2010, step 2110 further comprises positioning the terminating portion 121 such that the distal end 204 of the terminating portion 121 protrudes out of the second cavity 627 and beyond the back end wall 622 of the ferrule member 620. The method 2100 comprises a step 2120 of placing the cable shield 123 around a portion of the arm 320 of the housing 111. The method 2100 comprises a step 2130 of placing the ferrule tube 116 around a portion of the cable shield 123 such that the ferrule tube 116 surrounds at least a portion of both the cable shield 123 and the arm 320.

The method 2100 comprises a step 2140 of applying force against the ferrule member 620 in the axial direction to form a crimp connection between the terminating portion 121 of the conducting core 202 and the ferrule member 620. In some embodiments, step 2140 of method 2100 may include the same features of step 2130 of method 2000, as described above. The method comprises a step 2150 of compressing the ferrule tube 116 by using the lower and upper die members 1610, 1620 to form a crimp connection between the ferrule tube 116, the cable shield 123, and the arm 320 of the housing 300. In some embodiments, step 2150 includes engaging the ferrule tube 116 by the first and second recesses 1712, 1722 of the lower and upper die members 1610, 1620. In some embodiments, after step 2150, the method 2100 may further comprise a step of installing the cap 115 in the opening 303 of the top end wall 302 and pressing the cap 115 so that the cap 115 is flush with the top end wall 302. In other embodiments, when the connector assembly 100 is used in low frequency environments, the method 2100 may preclude the step of installing the cap 115 in the opening 303 of the top end wall 302.

In some embodiments, the step 2140 of applying force against the ferrule member 620 and the step 2150 of compressing the ferrule tube 116 are performed simultaneously by using the die assembly 1600. In some embodiments, the method 2100 comprises, before steps 2140 and 2150, placing the leg 330 of the housing 111 into the blind hole 1750 of the nest 1650 and placing the ferrule tube 116 received around the cable shield 123 and the arm 320 of the housing 111 between the aligned first, second recesses 1712, 1722 of the lower and upper die members 1610, 1620.

According to the various embodiments described above, the connector assembly may be implemented as various RF connector interfaces, including MMCX, MCX, or SMP. All dimensions described above may be adjusted or altered accordingly for each type of RF connector interface.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the claimed subject matter requires features or combinations of features other than those expressly recited in the claims. Accordingly, the scope of this disclosure is intended to include all modifications and variations encompassed within the spirit and scope of the following appended claims.

The invention claimed is:

1. A connector for coupling to a coaxial cable having a conducting core, the connector comprising:

a housing comprising a body having a central vertical axis and defining a chamber extending along the central vertical axis of the body;

a dielectric disposed in the chamber of the housing; and a signal contact disposed in the chamber of the housing and held by the dielectric, the signal contact comprising a head having a top face and an opposite bottom face, a ferrule member projecting away from the top face of the head such that a top surface of the ferrule member is spaced apart from the top face of the head, the top surface of the ferrule member having a first end and an opposite second end, and a front sidewall of the ferrule member extends from the top face of the head to the first end of the top surface of the ferrule member, and a male contact pin projecting away from the bottom face of the head, wherein the ferrule member comprises a first hole in the front sidewall and a passage extending from said first hole inwardly into the ferrule member in a direction parallel with the top face of the head, and the passage is configured to receive a terminating portion of the conducting core, and the head comprises a transverse dimension and the ferrule member comprises a lateral transverse dimension, and the lateral transverse dimension of the ferrule member is less than the transverse dimension of the head.

2. The connector of claim 1, wherein the ferrule member has a back sidewall, the back sidewall extends from the top face of the head to the second end of the top surface of the ferrule member, a second hole is formed in the back sidewall of the ferrule member, and the passage extends from the first hole in the front sidewall to the second hole in the back sidewall, thereby extending the entire length of the ferrule member.

3. The connector of claim 1, wherein the ferrule member is configured to be crimped to the terminating portion of the conducting core.

4. The connector of claim 1, wherein the housing further comprises, an arm projecting from a front wall of the body, and a leg projecting from a bottom end of the body.

5. The connector of claim 4, wherein the arm comprises a passage opening into the chamber, the passage of the arm is aligned with the passage of the ferrule member and configured to receive the conducting core of the coaxial cable.

6. The connector of claim 4, wherein the leg comprises a passage opening into the chamber; and wherein the male contact pin is received in the passage of the leg.

7. The connector of claim 1, wherein the male contact pin extends through a passage in the dielectric.

8. The connector of claim 1, wherein the dielectric comprises a plug having a top face, a bottom face, and a sidewall, and the bottom face of the head abuts against the top face of the plug.

9. The connector of claim 8, wherein the sidewall of the plug engages the interior surface of the housing, and the head and the ferrule member are spatially separated from the interior surface of the housing.

10. The connector of claim 1, wherein the dielectric includes a first hole and a second hole, the width of the first hole is greater than the width of the second hole, the male contact pin comprises an upper portion and a lower portion, and the upper portion of the male contact pin is disposed in the first hole of the dielectric and the lower portion of the male contact pin is disposed in the second hole of the dielectric.

11. The connector of claim 1, wherein the bottom face of the head has a maximum width, the male contact pin has a maximum width, and the maximum width of the head is greater than the maximum width of the male contact pin such that the bottom face of the head projects beyond the male contact pin in a transverse direction.

12. The connector of claim 11, wherein the male contact pin projects away from the center of the bottom face of the head.

13. A connector assembly comprising:

a coaxial cable comprising a conducting core extending along a longitudinal axis of the cable, an insulating sleeve received around the conducting core, and a cable shield having a first segment received around the insulating sleeve and a second segment spatially separated from the insulating sleeve proximate to a terminating end of the conducting core; and a connector comprising a housing having a body having a central vertical axis and defining a chamber extending along the central vertical axis, a dielectric disposed in the chamber of the housing, and a signal contact disposed in the chamber of the housing and held by the dielectric, wherein the signal contact comprises a head having a top face and an opposite bottom face, a ferrule member projecting away from the top face of the head such that a top surface of the ferrule member is spaced apart from the top face of the head, the top surface of the ferrule member having a first end and an opposite second end, and a front sidewall of the ferrule member extends from the top face of the head to the first end of the top surface of the ferrule member, and a male contact pin projecting away from the bottom face of the head, the ferrule member comprises a first hole in the front sidewall and a passage extending from said first hole inwardly into the ferrule member in a direction parallel with the top face of the head, a terminating portion of the conducting core is received in the passage of the ferrule member, and the ferrule member is crimped to the terminating portion of the conducting core.

14. The connector assembly of claim 13, wherein the housing further comprises an arm projecting from a front wall of the body in a direction transverse to the central vertical axis, and a leg projecting from a bottom end of the body in the central vertical axis.

15. The connector assembly of claim 13, wherein the arm comprises a passage extending transverse to the central vertical axis and opening into the chamber, the passage of the arm is aligned with the passage of the ferrule member; and wherein the conducting core and the insulating sleeve of the coaxial cable are received in the passage of the arm.

16. The connector assembly of claim 13, wherein the second segment of the cable shield is received around the arm, and the connector comprises a ferrule tube received around the second segment of the cable shield and the arm of the housing; and wherein the ferrule tube is crimped to the cable shield and the arm of the housing.

17. The connector assembly of claim 13, wherein the leg comprises a passage extending in the central vertical axis and opening into the chamber; and wherein the male contact pin is received in the passage of the leg.

18. The connector assembly of claim 13, wherein the head comprises a transverse dimension and the ferrule member comprises a lateral transverse dimension, and the lateral transverse dimension of the ferrule member is less than the transverse dimension of the head.

19. The connector assembly of claim 13, wherein the dielectric includes a first hole and a second hole, the width of the first hole is greater than the width of the second hole, the male contact pin comprises an upper portion and a lower portion, and the upper portion of the male contact pin is disposed in the first hole of the dielectric and the lower portion of the male contact pin is disposed in the second hole of the dielectric.

20. The connector assembly of claim 13, wherein the ferrule member has a back sidewall, the back sidewall extends from the top face of the head to the second end of the top surface of the ferrule member, a second hole is formed in the back sidewall of the ferrule member, and the passage extends from the first hole in the front sidewall to the second hole in the back sidewall, thereby extending the entire length of the ferrule member.

* * * * *